US008753220B2

(12) United States Patent
Roach et al.

(10) Patent No.: US 8,753,220 B2
(45) Date of Patent: Jun. 17, 2014

(54) PROGRESSIVE SET OF GOLF CLUB HEADS

(71) Applicant: Cobra Golf Incorporated, Carlsbad, CA (US)

(72) Inventors: Ryan L. Roach, Carlsbad, CA (US); Joshua G. Breier, Vista, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

(21) Appl. No.: 13/848,392

(22) Filed: Mar. 21, 2013

(65) Prior Publication Data

US 2013/0225312 A1 Aug. 29, 2013

Related U.S. Application Data

(62) Division of application No. 12/901,397, filed on Oct. 8, 2010, now abandoned.

(60) Provisional application No. 61/368,228, filed on Jul. 27, 2010.

(51) Int. Cl.
*A63B 53/04* (2006.01)

(52) U.S. Cl.
USPC ..... 473/291; 473/349; 473/350; 473/332

(58) Field of Classification Search
USPC ..... 473/287, 290–291, 332, 349–350
See application file for complete search history.

(56) References Cited

U.S. PATENT DOCUMENTS 3,473,370 A 10/1969 Marciniak
3,655,188 A 4/1972 Solheim
3,984,103 A * 10/1976 Nix ..... 473/291
4,754,969 A * 7/1988 Kobayashi ..... 473/290
D327,720 S 7/1992 Antonious
D328,116 S 7/1992 Antonious
5,316,298 A * 5/1994 Hutin et al. ..... 473/332
5,356,138 A 10/1994 Chen et al.
5,366,223 A 11/1994 Werner et al.
5,649,872 A * 7/1997 Antonious ..... 473/332
D387,113 S 12/1997 Burrows
D406,294 S 3/1999 Burrows
D411,272 S 6/1999 Burrows
D429,298 S 8/2000 Butler
6,341,690 B1 * 1/2002 Swiatosz ..... 206/315.6
6,435,977 B1 * 8/2002 Helmstetter et al. ..... 473/290
6,478,693 B2 * 11/2002 Matsunaga et al. ..... 473/345
6,506,127 B2 * 1/2003 Helmstetter et al. ..... 473/290
6,554,719 B2 * 4/2003 Peters et al. ..... 473/291

(Continued)

OTHER PUBLICATIONS

Werner, 2000, How Golf Clubs Really Work, Chapters 17-18, pp. 77-83, Origin Inc, Jackson, WY (9 pages).

*Primary Examiner* — Stephen L. Blau

(74) *Attorney, Agent, or Firm* — Mark S. Leonardo; Brown Rudnick LLP

(57) ABSTRACT

A set of progressive golf clubs with an elliptical pad construction on the back of the striking face that corresponds to a location, shape and size of a predetermined golfer's impact pattern for the lofts and lengths of each of the golf clubs in the set. The elliptical pad progressively changes in location, shape and size from the long irons, to the mid irons, to the short irons, and to the wedges, based on the location, shape and size of a predetermined golfer's impact pattern for each of the long irons, mid irons, short irons, and wedges.

15 Claims, 15 Drawing Sheets

(56) References Cited

U.S. PATENT DOCUMENTS

| | | | | |
|---|---|---|---|---|
| 6,860,819 | B2 * | 3/2005 | Gilbert | 473/291 |
| 6,863,621 | B2 | 3/2005 | Sherwood | |
| 6,935,967 | B2 | 8/2005 | Mahaffey et al. | |
| 6,997,820 | B2 * | 2/2006 | Willett et al. | 473/329 |
| 7,022,027 | B2 | 4/2006 | Chen | |
| D528,620 | S | 9/2006 | Kohno | |
| D539,862 | S | 4/2007 | Nunez et al. | |
| 7,207,900 | B2 | 4/2007 | Nicolette et al. | |
| D553,699 | S | 10/2007 | Nunez et al. | |
| D554,212 | S | 10/2007 | Nunez et al. | |
| 7,275,999 | B2 | 10/2007 | Sherwood | |
| D562,423 | S | 2/2008 | Foster et al. | |
| 7,338,388 | B2 | 3/2008 | Schweigert et al. | |
| 7,347,794 | B2 | 3/2008 | Schweigert | |
| D566,803 | S | 4/2008 | Foster et al. | |
| 7,351,164 | B2 | 4/2008 | Schweigert et al. | |
| 7,410,424 | B2 | 8/2008 | Chen | |
| D593,627 | S | 6/2009 | Kim et al. | |
| D595,797 | S | 7/2009 | Oldknow | |
| D596,684 | S | 7/2009 | Sutovsky et al. | |
| D597,157 | S | 7/2009 | Wallin et al. | |
| D597,617 | S | 8/2009 | Ines et al. | |
| D597,618 | S | 8/2009 | Ines et al. | |
| D598,060 | S | 8/2009 | Barez et al. | |
| D601,215 | S | 9/2009 | Diaz et al. | |
| 7,584,531 | B2 | 9/2009 | Schweigert et al. | |
| D601,651 | S | 10/2009 | Jorgensen et al. | |
| D602,103 | S | 10/2009 | Jorgensen et al. | |
| D621,893 | S | 8/2010 | Nicolette et al. | |
| 2004/0214655 | A1 | 10/2004 | Reed et al. | |
| 2004/0259658 | A1 | 12/2004 | Sherwood | |
| 2006/0293118 | A1 | 12/2006 | Meyer et al. | |
| 2007/0000584 | A1 * | 1/2007 | Reynolds et al. | 150/160 |
| 2007/0042837 | A1 | 2/2007 | Bamber | |
| 2009/0032154 | A1 * | 2/2009 | Quartarone, III | 150/160 |
| 2009/0149277 | A1 | 6/2009 | Deng et al. | |
| 2009/0280923 | A1 | 11/2009 | Park et al. | |
| 2010/0041493 | A1 | 2/2010 | Clausen et al. | |
| 2010/0048318 | A1 | 2/2010 | Clausen | |
| 2010/0093460 | A1 | 4/2010 | Gilbert et al. | |
| 2010/0273570 | A1 * | 10/2010 | Ines et al. | 473/342 |

* cited by examiner

PROGRESSIVE SET OF GOLF CLUB HEADS

CROSS REFERENCE TO RELATED APPLICATIONS

This application is a divisional application of U.S. patent application Ser. No. 12/901,397, filed on Oct. 8, 2010, which application claims the benefit of U.S. Provisional Application No. 61/368,228, filed Jul. 27, 2010, which is incorporated by reference herein in its entirety.

FIELD OF THE INVENTION

Certain embodiments discussed herein relate to a set of progressive golf clubs, and, more particularly, the present invention relates to a set of progressive golf clubs heads with a swing pad.

BACKGROUND OF THE INVENTION

Golf club heads come in many different forms and makes, such as wood- or metal-type, iron-type (including wedge-type club heads), utility or specialty-type, and putter-type. Each of these types has a prescribed function and make-up. The present invention will be discussed as relating to iron-type clubs, but the inventive teachings disclosed herein may be applied to other types of clubs.

Iron-type golf club heads generally include a front or striking face, a back, a toe, a heel, a top line, a hosel, and a sole. The front face interfaces with and strikes the golf ball. A plurality of grooves, sometimes referred to as score lines, is provided on the face to assist in imparting spin to the ball. The back can also be described as the back of the striking face and may vary in design, depending whether the iron-type golf club head is a blade, muscle back or cavity back design. The hosel is generally configured to have a particular look to the golfer, to provide a lodging for the golf shaft, and to provide structural rigidity for the club head. The sole of the golf club is particularly important to the golf shot because it contacts and interacts with the playing surface during the swing. The toe is the region of the golf club head that is distal to the shaft, while the heel is the region of the golf club head that is proximal to the shaft. The top line is the uppermost region of the golf club head, extending between the toe and heel of the golf club head.

In conventional sets of iron-type golf clubs, each club includes a shaft with a club head attached to one end of the shaft, and a grip attached to the other end of the shaft. The club head includes a face for striking a golf ball. The angle between the face and a vertical plane is called the loft angle.

The set generally includes irons that are designated number 3 through number 9, and a pitching wedge. One or more additional long irons, such as those designated number 1 or number 2, and wedges, such as a gap wedge, a sand wedge, and a lob wedge, may optionally be included with the set. Alternatively, the set may include irons that are designated number 4 through number 9, a pitching wedge, and a gap wedge. Long irons are typically designated with the numbers 1, 2, 3, 4 or 5. Mid-irons are typically designated with the numbers 6 or 7. Short irons are typically designated with the numbers 8 or 9. Wedges are typically designated with the letters P (pitching wedge), G (gap wedge), S (sand wedge), or L (lob wedge), or may be designated with the degree of the loft angle (e.g., 52°, 54°, 56°, 58°, 60°, etc.). Alternatively, the set may also include hybrid-type golf clubs, which typically replace the long irons, such as the 1, 2, 3, 4 and 5 irons. Each iron has a shaft length that usually decreases through the set as the loft for each club head increases from the long irons to the short irons. The overall weight of each club head increases through the set as the shaft length decreases from the long irons to the short irons. To properly ensure that each club has a similar feel or balance during a golf swing, a measurement known as swingweight is often used as a criterion to define the club head weight and the shaft length. Because each of the clubs within the set is typically designed to have the same swingweight value for each different lofted club head or given shaft length, the weight of the club head is often confined to a particular range.

The length of the shaft, along with the club head loft, moment of inertia, and center of gravity location, impart various performance characteristics to the ball's launch conditions upon impact and dictate the golf ball's launch angle, spin rate, flight trajectory, and the distance the ball will travel. Flight distance generally increases with a decrease in loft angle and an increase in club length. However, difficulty of use also increases with a decrease in loft angle and an increase in club length.

Iron-type golf clubs generally can be divided into three categories: blades and muscle backs, conventional cavity backs, and modern multi-material cavity backs. Blades are traditional clubs with a substantially uniform appearance from the sole to the top line, although there may be some tapering from sole to top line. Similarly, muscle backs are substantially uniform, but have extra material on the back thereof in the form of a rib that can be used to lower the club head center of gravity or improve feel. A club head with a lower center of gravity than the ball center of gravity facilitates getting the golf ball airborne. Because blade and muscle back designs have a small sweet spot, which is a term that refers to the area of the face that usually results in a desirable golf shot upon striking a golf ball, these designs are relatively difficult to wield and are typically only used by skilled golfers. However, these designs allow the skilled golfer to work the ball and shape the golf shot as desired.

Cavity backs move some of the club mass to the perimeter of the club by providing a hollow or cavity in the back of the club, opposite the striking face. The perimeter weighting created by the cavity increases the club's moment of inertia, which is a measurement of the club's resistance to torque, for example, the torque resulting from an off-center hit. This produces a more forgiving club with a larger sweet spot. Having a larger sweet spot increases the ease of use. The decrease in club head mass resulting from the cavity also allows the size of the club face to be increased, further enlarging the sweet spot. These clubs are easier to hit than blades and muscle backs, and are therefore more readily usable by less-skilled and beginner golfers.

SUMMARY OF THE INVENTION

Some embodiments are a set of progressive golf clubs. In particular, some embodiments relate to a set of progressive golf clubs heads with a swing pad construction that corresponds to a location, shape and size of a predetermined golfer's impact pattern for the lofts and lengths of each of the golf clubs in the set.

Golfers generally do not strike the ball exactly at the sweet spot of the club, each and every time, due to factors like skill, physical fitness, course conditions and lie. Instead, golfers strike the ball in various locations on the striking face of the golf club. It has been determined that these various locations may be approximated by an elliptical pattern on the striking face. Further, Applicants have determined that this elliptical pattern differs between golfers of various skill levels, which can be approximated by handicaps. Also, Applicants have determined that this elliptical pattern differs between the long irons, mid-irons, short irons and wedges, for a golfer of a given skill level.

For a given golfer or a group of golfers of a given skill level, the elliptical pattern on the striking face encompasses the majority of the ball strikes and, preferably, at least 60%, 70%, 75%, 80% or 90% of the ball strikes for a golf club of a given loft. Thus, in certain embodiments, a golf club head of a given loft and length may be optimized for any given golfer or group of golfers of a given skill level, based on, for example, the elliptical pattern. Moreover, Applicants have determined that each golf club head may be individually optimized for any given golfer or group of golfers of a given skill level based on, for example, the elliptical pattern, thereby resulting in a progressive set of golf clubs or golf club heads.

In one embodiment of the invention, a swing pad is positioned on the back of the striking face of the golf club head, correlating to the location, shape and size of a predetermined golfer's impact pattern, based on the loft and club length of the golf club. Thus, for a given golfer or a group of golfers of a given skill level, the swing pad on the back of the striking face corresponds in location, shape and size to the majority of the ball strikes and, preferably, at least 60%, 70%, 75%, 80% or 90% of the ball strikes for a golf club of a given loft. The swing pad is an area of increased thickness, such as a projection, positioned on the back of the striking face of the golf club head. The swing pad has a pre-determined thickness and may be made of a material that is the same or different from the material of the striking face. Desirably, the swing pad has a constant thickness. The swing pad is typically made of a metallic material. In one embodiment, the swing pad may be described as an elliptical pad. In some embodiments, the swing pad is integrally formed with the striking face of the golf club head. In other embodiments, the swing pad is integrally formed with the striking face and the body of the golf club head.

There are many benefits due to the swing pad. One benefit is that the sweet spot is generally larger due to the addition of the swing pad as compared to a golf club head without the swing pad. This results in golfers achieving a better ball flight, distance and result. Another benefit is that the golf club with the swing pad on the back of the striking face of the golf club head feels better at impact, primarily due to the additional mass of the swing pad behind the impact point as compared to a golf club without the swing pad. In some embodiments, weight can be removed from the striking face of the club head without sacrificing feel. This is due to the presence of the swing pad behind the impact point, which allows the area surrounding the swing to be thinner. The removed material can be placed elsewhere to improve other characteristics of the club head. In some embodiments where the swing pad has a uniform thickness, this constant thickness may further enhance the feel of the golf club by providing a constant sensation for the majority of ball strikes, because the majority of ball strikes for a given golfer or group of golfers of a given skill level would occur within or near the swing pad zone.

Another benefit of the swing pad is more consistent ball flight, distance and result as compared to a golf club head without the swing pad. Golf club heads without the swing pad typically have a constant striking face thickness. This results in a high coefficient of restitution (COR) in the center of the striking face. The coefficient of restitution decreases away from the center of the striking face. This results in ball flight and distance that is less than optimal compared to an impact in the center of the striking face. One result is that for the average impact (that is not in the exact center of the striking face) for a given golfer or group of golfers of a given skill level, the ball will achieve its desired distance, or fall short of its intended target (e.g., the green). However, if the golfer performs an above average golf swing, and impacts the ball near or exactly at the center of the striking face, then the ball will achieve too much distance and fly over its intended target (e.g., the green). This problem is more common in golfers of less skill and higher handicap, whose golf swing impacts the ball all over the striking face, as compared to better golfers that strike the ball more consistently near the center of the striking face. In some embodiments, the swing pad of constant thickness results in a constant COR across the entire swing pad zone, which accounts for the majority of ball strikes for a given golfer or group of golfers of a given skill level.

Another benefit of the swing pad is durability. Because most of the impact for a given golfer or group of golfers of a given skill level occurs in the swing pad zone, the extra mass and material of the swing pad gives the golf club head more durability in the area of the golf club head that receives the most impact. This enhanced durability of the swing pad zone of the striking face allows the rest of the striking face to be thinner, as compared to a golf club head with a constant face thickness. As a result of the rest of the striking face being thinner, for example, to less than 3.1 mm, the material savings can be shifted to other areas of the golf club head. For example, material can be shifted to the sole of the club to lower the center of gravity (CG), or material can be shifted to the perimeter of the club to increase the moment of inertia (MOI), of the club head.

In one embodiment of the invention, the swing pad varies between long irons, mid-irons, short irons and wedges, correlating to the location, shape and size of a given golfer or group of golfer's impact pattern for the particular golf club of a given loft and length. If the swing pad is elliptical, it will have a major axis and minor axis. The major axis extends between the toe and heel of the club. The minor axis extends between the top line and sole of the club. The major axis is generally horizontal and the minor axis is generally vertical. In the long irons the elliptical pad desirably has a major axis that is much larger than the minor axis. In the wedges, the elliptical pad has a major axis that is desirably about the same size as the minor axis. In the mid-irons, the elliptical pad desirably has a major axis that is larger than the minor axis but the difference is desirably not as large as in the long irons. Similarly, in the short irons in the elliptical pad desirably has a major axis that is larger than the minor axis but the difference is desirably not as large as in the mid-irons.

In one embodiment of the invention, the golf club head has an elastomeric insert that also corresponds to the location, shape and size of a given golfer or group of golfer's impact pattern for the particular golf club of a given loft and length. The elastomeric insert may be attached adjacent to the swing pad. The elastomeric insert desirably provides damping and is more effective than a typical insert, because the elastomeric insert is centered behind the impact area of the majority of the face strikes for a given golfer or group of golfers of a particular skill level, and shaped like the impact pattern for a given golfer or group of golfers of a particular skill level. The typical insert may be improperly positioned or be of a shape and size that does not correlate to the impact pattern for a given golfer or group of golfers of a particular skill level.

DESCRIPTION OF THE DRAWINGS

The present invention is described with reference to the accompanying drawings, in which like reference characters reference like elements, and wherein.

DETAILED DESCRIPTION OF THE INVENTION

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1A:
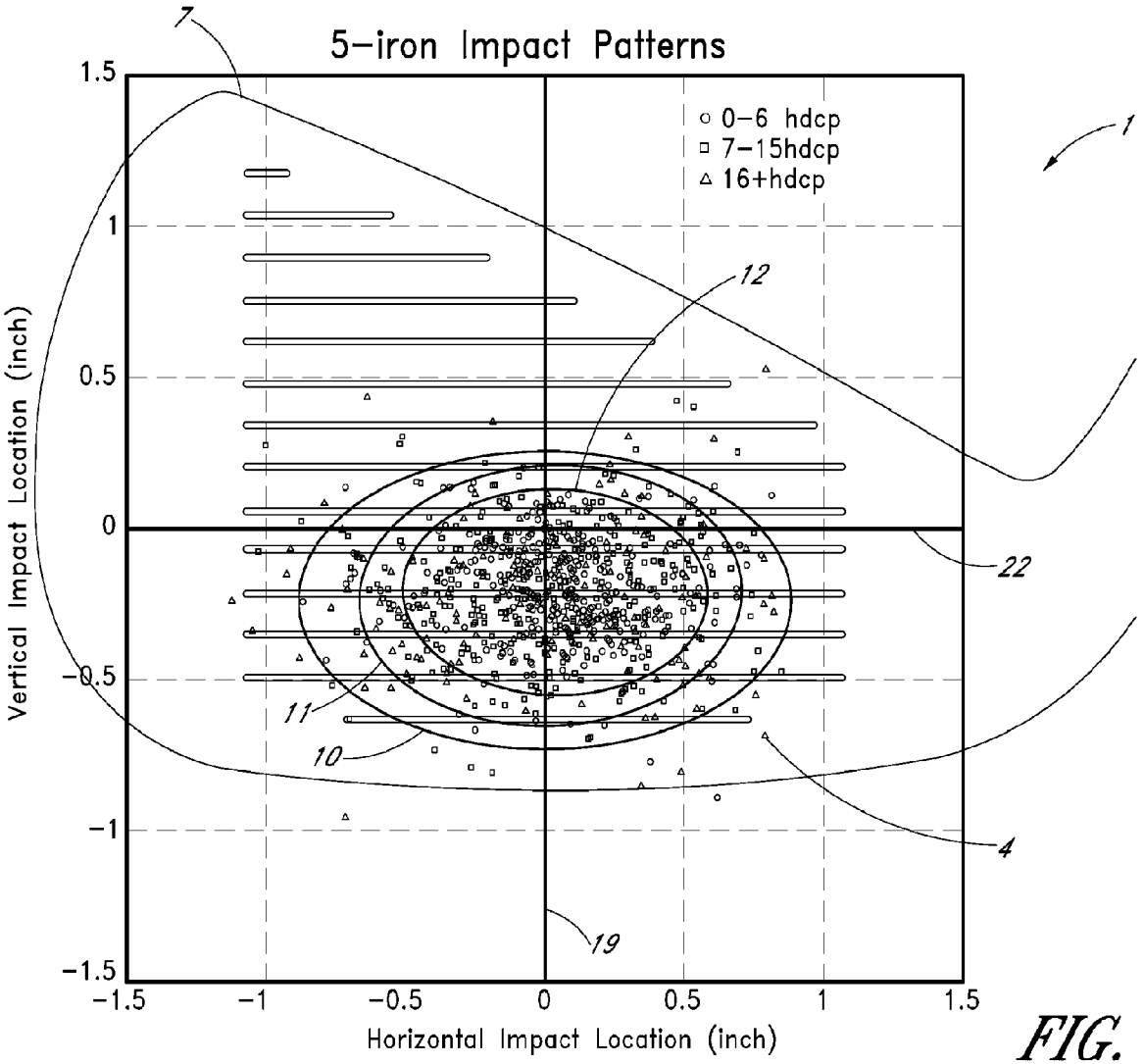
FIGS. 1A, 1B and 1C are a series of diagrams showing the impact pattern for a 5 iron, 8 iron and a pitching wedge.
Figure 1B:
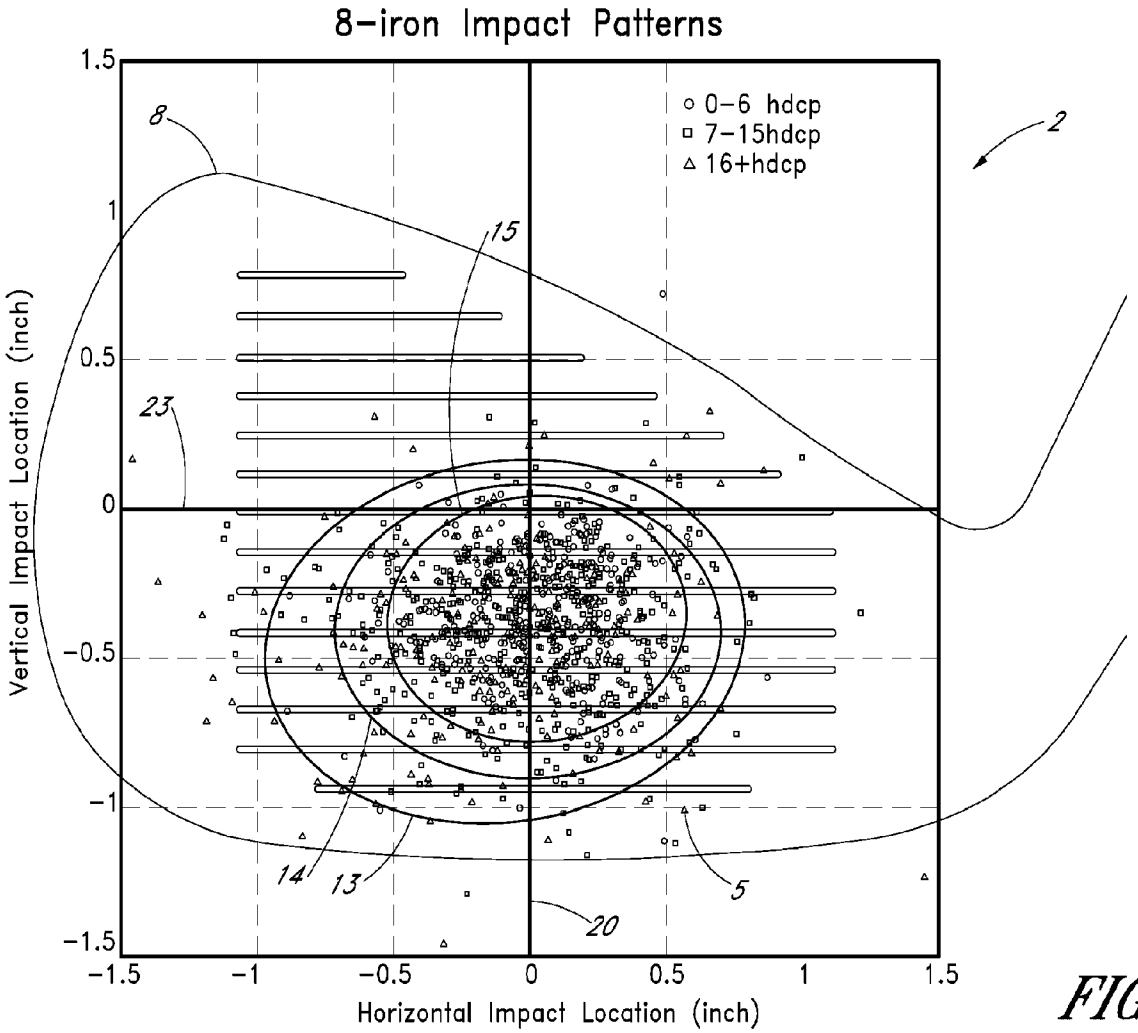
Figure 1C:
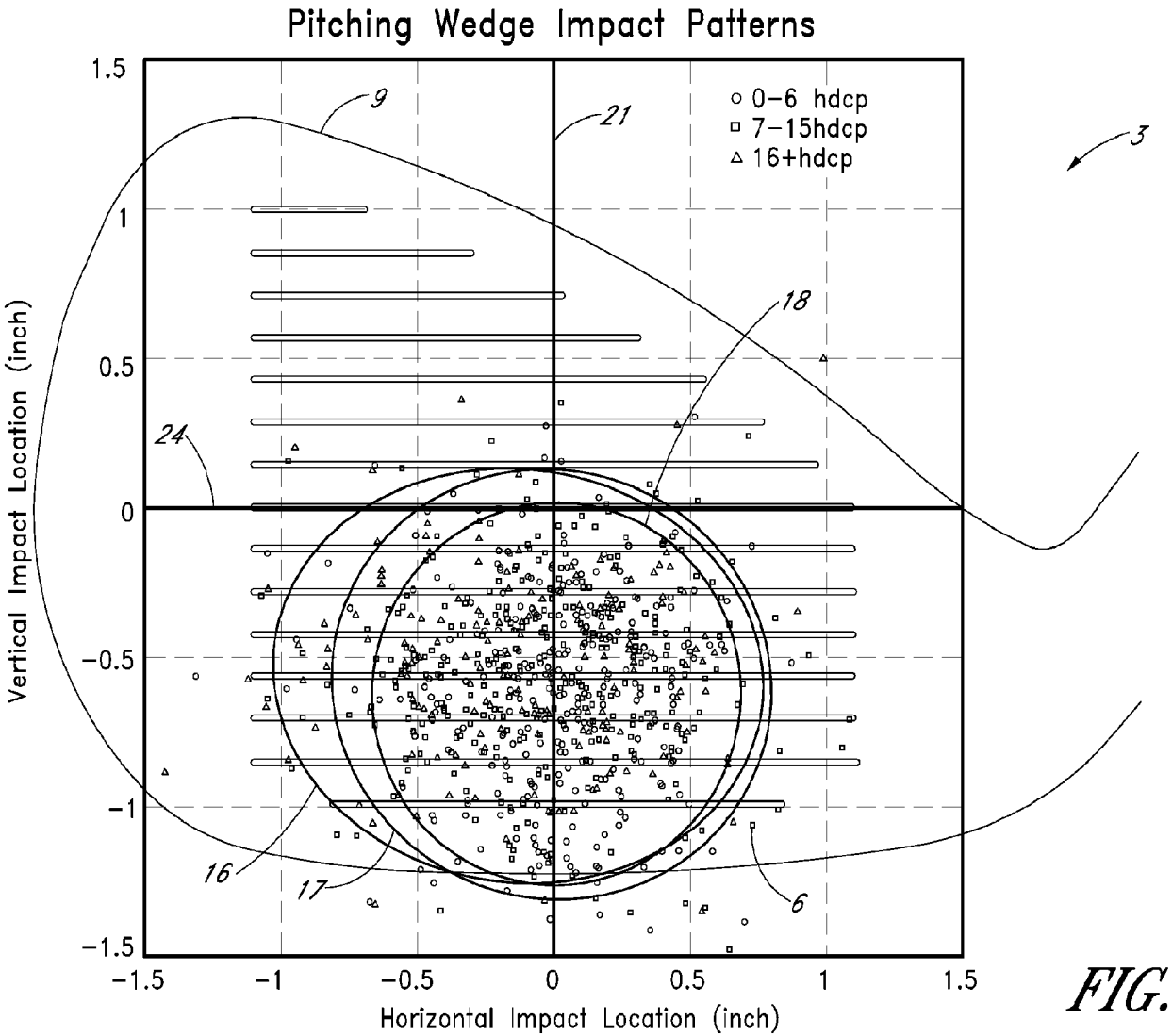
Figure 2:
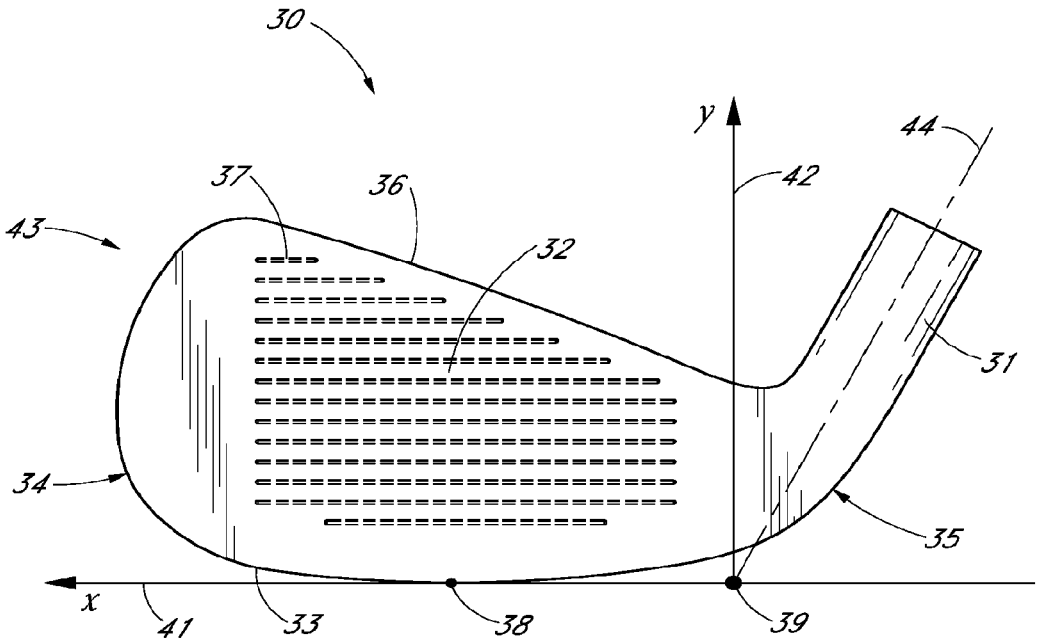
FIG. 2 is a front elevational view of an embodiment of the golf club head of the present invention.
Figure 3:
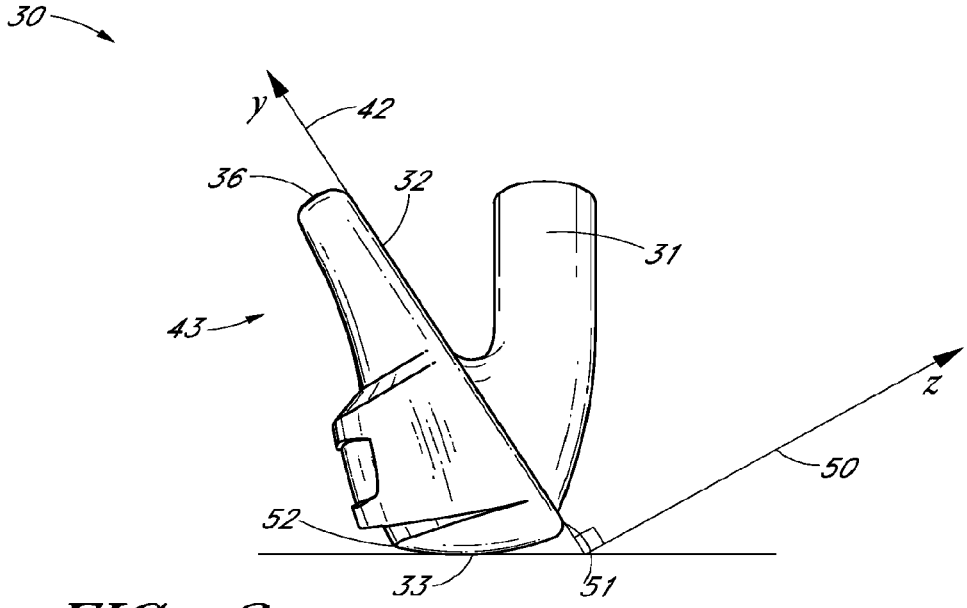
FIG. 3 is a left elevational view of an embodiment of the golf club head of the present invention.

FIGS. 1A, 1B and 1C are a series of diagrams showing the impact pattern for a 5 iron 1, 8 iron 2 and a pitching wedge 3. Diagrams 1, 2 and 3 are impact pattern data plots based on research conducted for various golfers of varying skill. Each point (representational points 4, 5 and 6) on diagrams 1, 2 and 3 indicate the impact location of the ball with the striking face of the golf club head for one golf swing with the specified golf club for one golfer. The outline of a typical golf club 7, 8 and 9 is approximated in each diagram. The horizontal centers 19, 20 and 21 and vertical centers 22, 23 and 24 of the golf club heads used in testing are shown for each of the 5 iron, 8 iron and pitching wedge. It should be noted that the golf club head shown in the outlines of a typical golf club head 7, 8 and 9 is not the golf club head that was used to gather the data, but is a representation. Different sized and shaped iron golf club heads of various designs were used to gather the data. Thus, it can be seen that some data points lie outside the boundary of the outlines of the typical golf club head 7, 8 and 9, and that the horizontal centers 19, 20 and 21 do not necessarily correspond to the horizontal center of the outline of the typical golf club heads 7, 8 and 9. The horizontal center of a golf club is defined as the midpoint between the top line and the sole of the golf club head, as measured along the striking face of the golf club head (in the y-axis as shown in FIGS. 2 and 3), from the point where the sole touches the playing surface during a golfer's address position (e.g., 38 in FIG. 2). After compiling data on many swings by golfers of varying skill, an elliptical pattern emerges. The majority of the impact locations for a less skilled golfer with a handicap of 16 or greater, is contained within the ellipses 10, 13 and 16. The majority of the impact locations for a more skilled golfer with a handicap of 7 to 15, is contained within the ellipses 11, 14 and 17. The majority of the impact locations for a highly skilled golfer with a handicap of 0 to 6, is contained within the ellipses 12, 15 and 18. The term "majority" in this instance may be defined according to the desired result. For example, impact pattern may be drawn to encompass 51% (a majority) of the face strike impact data points for a given golfer or a group of golfers. Alternatively, an impact pattern may be drawn to encompass 60%, 75% or 90% (also a majority) of the face strike impact data points for a given golfer or a group of golfers.

After analyzing the impact pattern data plots, Applicants have come to the following conclusions. First, golfers of less skill typically have the largest sized distribution of impact locations for a golf club of any loft or length, as compared to golfers of higher skill. Second, the distribution of impact of patterns tends to become more circular as a golf club increases in loft and shortens in shaft length. Finally, the distribution of impact locations tends to be centered lower on the golf club face as the golf club increases in loft and shortens in shaft length.

FIG. 2 is a front elevational view of an embodiment of the golf club head of the present invention. The golf club head 30, has a body 43 defining a striking face 32, a hosel 31, a sole 33, a top line 36, a toe 34 and a heel 35. The front face typically has plurality of grooves 37, sometimes referred to as score lines, to assist in imparting spin to the ball. The x-axis 41 is horizontal and approximates the ground on which the golf club head rests during address by a golfer. A grounding point 38 at roughly the midpoint of the sole contacts the ground (x-axis) at approximately midpoint between the heel and toe of the golf club head during proper address by a golfer. The center line 44 of the hosel is also the center line of the shaft. The intersection of the center line 44 of the hosel extended to the x-axis is defined as the origin 39. The y-axis 42 is defined in the direction along the face 32 of the golf club head 30.

FIG. 3 is a left elevational view of an embodiment of the golf club head of the present invention. The sole 33 of the golf club contacts the ground approximately midpoint between the leading edge 51 and trailing edge 52 of the golf club during proper address by a golfer. The z-axis 50 is defined in the direction normal to the face 32 of the golf club head 30.

Figure 4:
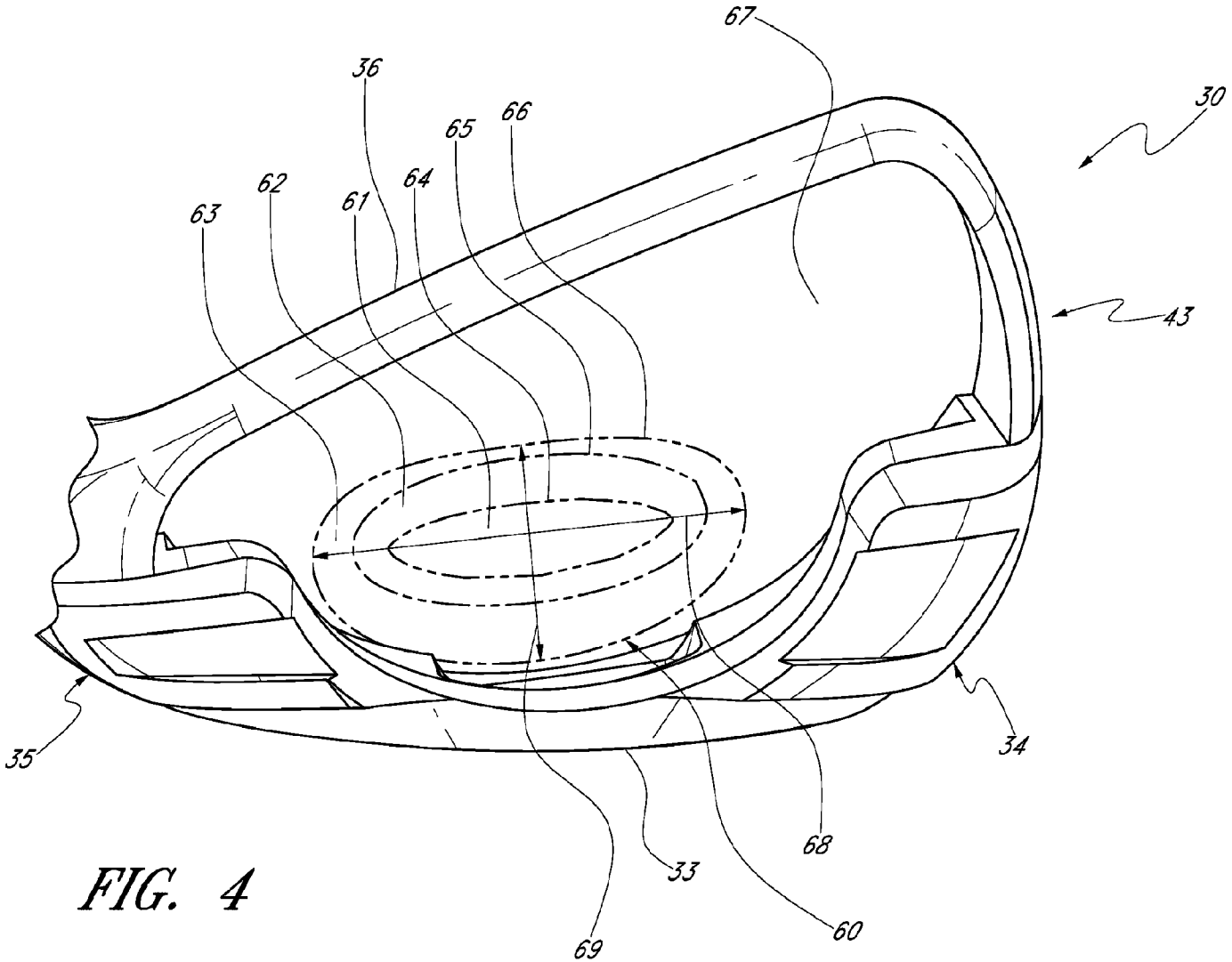
FIG. 4 is a rear view of an embodiment of the golf club head of the present invention, showing the area of the back of the striking face and the elliptical pad area.

FIG. 4 is a rear view of an embodiment of the golf club head of the present invention, showing the back of the striking face and the elliptical pad area. The back of the striking face 67, has a swing pad and, preferably, an elliptical pad 60. The elliptical pad 60 has a major axis 68 and minor axis 69. The major axis 68 is oriented from the heel 35 to toe 34 of the golf club head 30. The minor axis 69 is oriented from the top line 36 to the sole 33 of the club head 30. Thus, the major axis 68 is oriented parallel to the x-axis 41, and the minor axis 69 is oriented parallel to the y-axis 42. The dimension of the major axis 68 is typically larger than the dimension of the minor axis 69.

The elliptical pad 60 has a location, shape and size that desirably corresponds to the location, shape and size of a predetermined golfer's impact pattern based on a given loft and club length of a golf club. For example, if it is desired to construct a progressive golf club set for a better player with a handicap between 7 and 15, the golf club head for a 5 iron will have an elliptical pad 60 that corresponds to a given predetermined impact location. In one embodiment, this will be the location, shape and size of the ellipse 11 of FIG. 1. Similarly, the golf club heads for an 8 iron and pitching wedge will each have an elliptical pad 60 that corresponds to a given predetermined impact location. In one embodiment, this will be the location, shape and size of the ellipse 14 and 17 for the 8 iron and pitching wedge respectively as shown in FIG. 1. Likewise, if it is desired to construct a progressive golf club set for a highly skilled player with a handicap between 0 and 6, then desirably the golf club heads for a 5 iron, 8 iron and pitching wedge will each have an elliptical pad 60 that corresponds to a given predetermined impact pattern. In one embodiment, this will be the location, shape and size of the ellipse 12, 15 and 18 respectively as shown in FIG. 1. Further, if it is desired to construct a progressive golf club set for a low skilled player with a handicap greater than 15, then desirably the golf club heads for a 5 iron, 8 iron and pitching wedge will each have an elliptical pad 60 that corresponds to a given predetermined impact pattern. In one embodiment, this will be the location shape and size of the ellipse 10, 13 and 16. It is understood that the location, shape and size of the elliptical pad 60 may be correlated to any given golfer, or group of golfers by plotting the impact pattern across various clubs of varying lofts and club lengths for the given golfer or group of golfers. It is also understood that while the above example relates to only a 5 iron, 8 iron and pitching wedge, each and every iron in a progressive golf club set may have an elliptical pad 60 that is correlated to be elliptical impact pattern for the loft and shaft length of each and every iron in a golf club set.

The elliptical pad 60 may be comprised of a single ellipse, or multiple ellipses or transitional areas. In one embodiment shown in FIG. 4, the elliptical pad 60 has three zones, 61, 62 and 63. The border 64 separates the first zone 61 and second zone 62. The border 65 separates the second zone 62 and third zone 63. The border 66 defines the outermost boundary of the elliptical pad 60, separating the elliptical pad 60 from the rest of the back of the striking face 67.

The three zones, 61, 62 and 63 may be of varying thicknesses. The thickness in this context may be measured from a point on the elliptical pad 60 to the back of the striking face 67, in a direction normal to the plane of the back of the striking face 67 (i.e., in the −z direction). For example, the first zone 61 may be of one thickness. The second zone 62 and third zone 63 are of thicknesses between that of the first zone 61 and the rest of the back of the striking face 67. Typically, the second zone 62 the third zone 63 provide a transition between the thickness of the first zone 61 and the rest of the back of the striking face 67, and therefore, typically varies in thickness between the thickness of the first zone 61 and zero.

In one embodiment, the elliptical pad 60 may be comprised of multiple ellipses. For example, the ellipse enclosed by boundary 64 is a first ellipse, the ellipse enclosed by boundary 65 is a second ellipse, and the ellipse enclosed by boundary 66 is a third ellipse. Each of these multiple ellipses may separately correspond to any ball striking impact pattern. For example, the first ellipse has a first location and first size, the first location and first size corresponding to a predetermined golfer's or group of golfers' (of similar skill level) first impact pattern based on a loft and club length of a first golf club head. The second ellipse has a second location and second size, the second location and second size corresponding to a predetermined golfer's or group of golfers' (of similar skill level) second impact pattern based on the loft and club length of the same first golf club. That is, for instance, the first ellipse corresponds to the impact pattern of "good" ball strikes for a predetermined golfer or group of golfers of similar skill, while the second ellipse corresponds to the majority of the rest of the ball strike impact pattern for the predetermined golfer or group of golfers of similar skill. In another embodiment, the first ellipse corresponds to the impact pattern for a highly skilled player with a handicap between zero and 6, the second ellipse corresponds to the impact pattern for a skilled player with a handicap between 7 and 15, and the third ellipse corresponds to the impact pattern for a less skilled player with a handicap greater than 16. These multiple ellipses may have the same center location, or may have different center locations depending on the desired impact pattern location.

As discussed, because the majority of the ball impacts for a given golfer or group of golfers desirably occurs within the elliptical pad 60, the result is a golf club that feels more solid, has more consistent ball flight, distance and result, and is more durable, as compared to a golf club with a constant thickness striking face. In some embodiments, the pad 60 may be smaller than the actual ball impact pattern for a given golfer or group of golfers. The size and shape of the pad 60 can be altered to address other concerns, such as weight savings.

In some embodiments, the pad 60 is not an ellipse. Instead, it may be an irregular shaped region that may or may not be precisely described in geometric terms. Desirably, however, the pad behind the striking face encompasses the majority of the ball strikes and, preferably, at least 60%, 70%, 75%, 80% or 90% of the ball strikes for a golf club of a given loft. In some embodiments, the swing pad is not an ellipse at all, but a different shape, for example, a triangle, rectangle, square, hexagon or other polygons or irregular shapes. However, a non-elliptical pad, such as a square for example, will not be an optimally shaped swing pad because it does not optimally correlate with the aforementioned ball strike impact patterns, which are elliptical shaped. For example, if it is desired to create a square-shaped swing pad that encompasses 75% of the ball strikes for a golf club of a given loft (for a given golfer or a group of golfers of a given skill level), that square-shaped swing pad would be expected to be larger in area than an elliptical shaped swing pad (elliptical pad) that encompasses 75% of the ball strikes for the same golf club (for the same golfer or group of golfers of a given skill level). This is because the aforementioned ball strike impact patterns are inherently elliptical shaped. Thus, the square-shaped swing pad covering a certain percentage of ball strikes and having a particular thickness would be heavier than an elliptical shaped swing pad covering the same percentage of ball strikes having the same thickness. This would result in extra weight due to the excess of the square-shaped swing pad. In contrast, in the elliptical shaped swing pad design, the weight savings (compared to the square-shaped swing pad) can be shifted to other portions of the club head to improve, for example, the CG or MOI of the golf club head. Further, when implementing a square-shaped swing pad, some peripheral portions of that square-shaped swing pad (e.g., upper heel and upper toe corners) would be positioned in locations where few ball strikes would be expected to occur, thus there is significantly less benefit derived from having a square-shaped pad (that would extend to those locations). Thus, the square-shaped swing pad could be considered undesirable as compared to an elliptical shaped swing pad.

In some embodiments, the elliptical pad 60 may be comprised of the same or a different material then the rest of the back striking face 67 or the golf club body 43. For example, the golf club body 43, including the rest of the back of the striking face 67 may be constructed of a first material, and without the elliptical pad 60, which results in a golf club head with a constant thickness striking face. The elliptical pad 60 may constructed of a second material, and attached to the back of the striking face by various techniques known in the mechanical arts, such as welding, mechanical fastening, and brazing. The second material of the elliptical pad 60 may have different material properties than the first material of the golf club body 43, for instance, the second material of the elliptical pad 60 may be more dense than the first material of the golf club body 43. In one embodiment, the golf club body 43, including the rest of the back of the striking face 67, except for the area of the golf club body 43 including the striking face adjacent to the elliptical pad 60, may be constructed of a first material. The elliptical pad 60 and the area of the golf club body 43 adjacent to the elliptical pad 60, which would include the front striking face of the golf club 30, may be constructed of a second material. The elliptical pad 60 constructed of the second material, and the portion of the front striking face of the golf club 30 adjacent the elliptical pad 60 that is also constructed of the second material, may be a monolithic structure, or may be two or more separate pieces. These pieces would be attached together, and would be attached to the golf club body 43.

Figure 5:
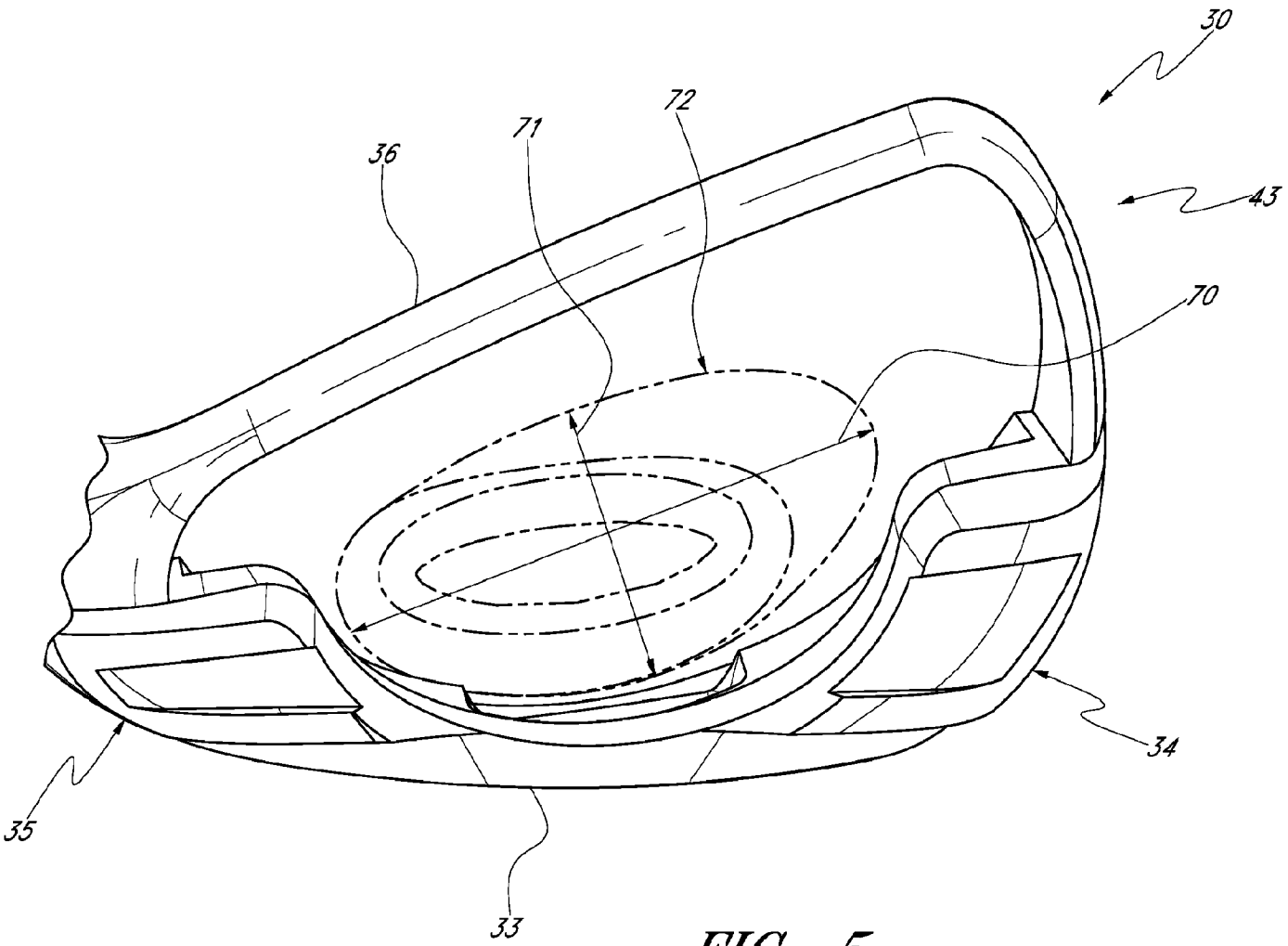
FIG. 5 is a rear view of an embodiment of the golf club head of the present invention, showing the area of the back of the striking face and the elliptical pad area.

FIG. 5 is a rear view of an embodiment of the golf club head of the present invention, showing the area of the back of the striking face and the elliptical pad area. In this embodiment, the elliptical pad 72 has a major axis 70 that is angled from the profile of the sole 33, and is oriented from a point towards both the heel 35 and the sole 33, to a point towards both the toe 34 and the top line 36. For longer irons, especially when hitting a golf ball off the tee, the impact pattern for a given golfer or group of golfers of a particular skill level for a golf club of a given loft and shaft length is angled from the sole of the golf club. Thus, a golf club head 30 with an elliptical pad 70 that is angled to match the impact pattern for a given golfer or group of golfers of a particular skill level for a given golf club of a given loft and shaft length, will generate the benefits discussed above to a greater extent.

Figure 6:
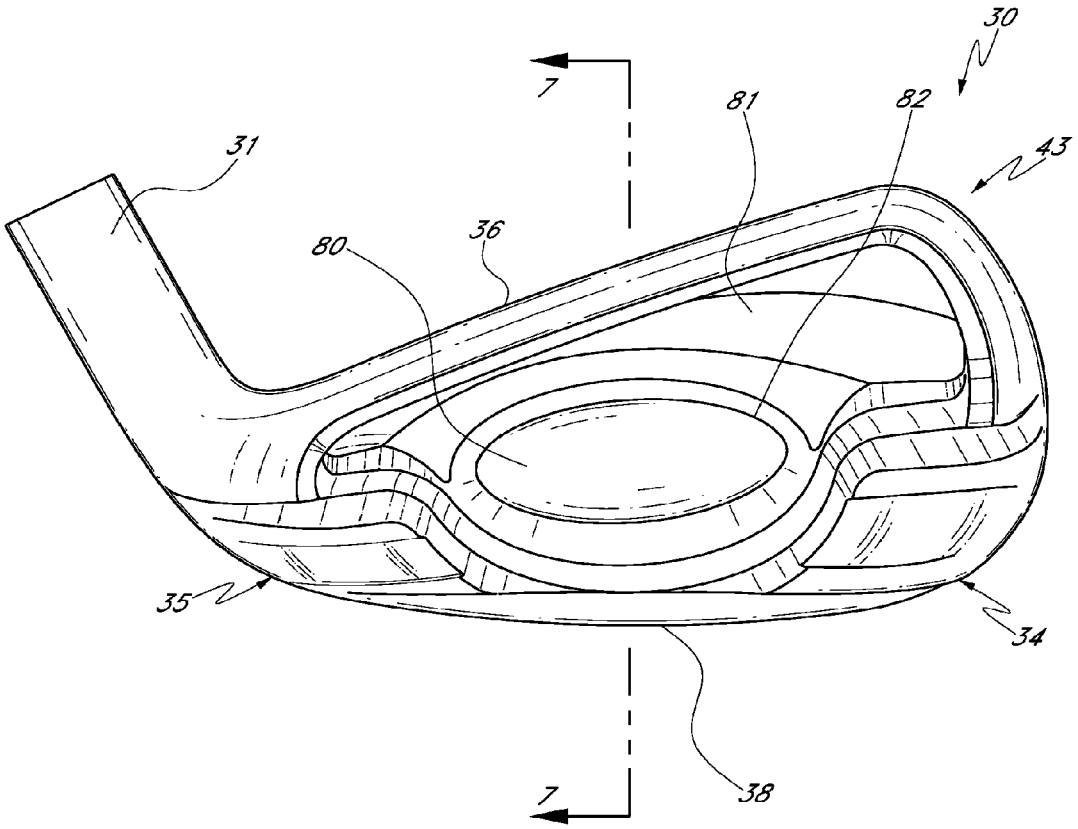
FIG. 6 is a rear view of an embodiment of the golf club head of the present invention, showing an elastomeric insert.
Figure 9:
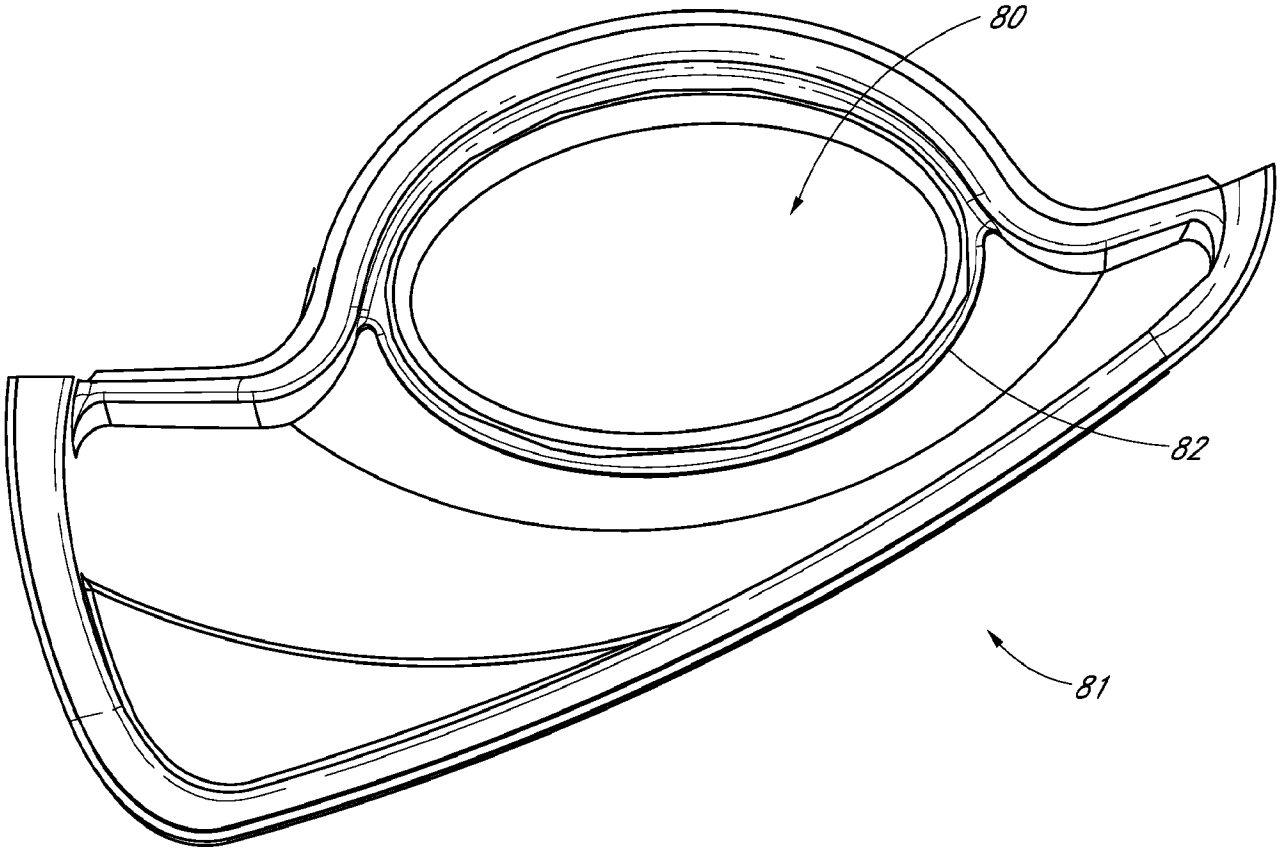
FIG. 9 front view of an embodiment of the elastomeric insert of the present invention.
Figure 10:
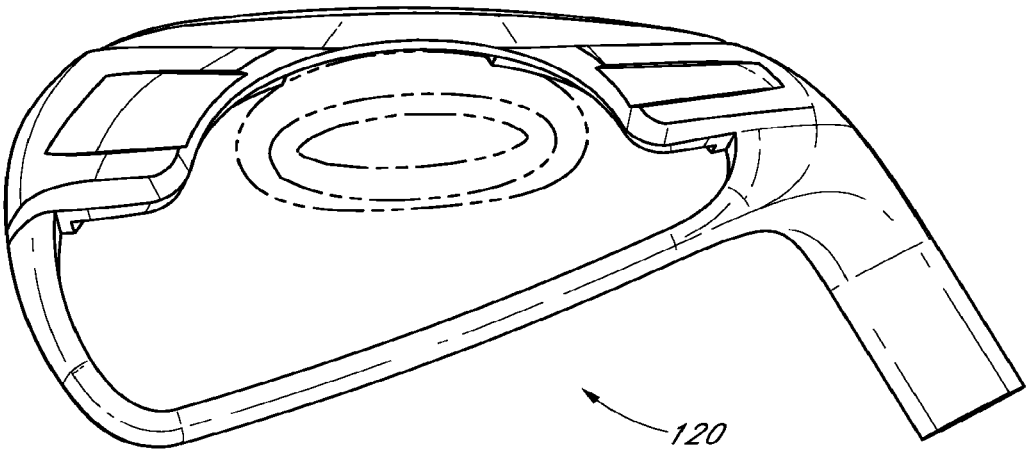
FIG. 10 is a rear view of an embodiment of a 3 iron golf club head of the present invention.
Figure 11:
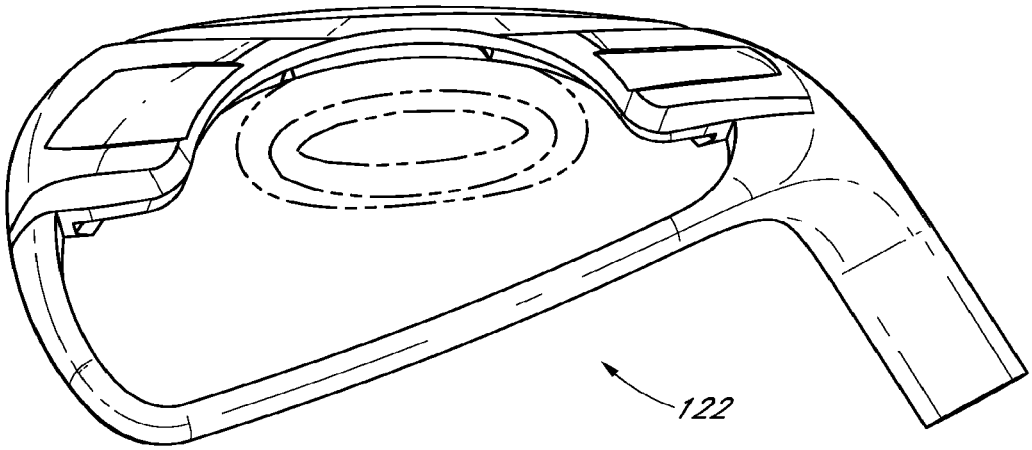
FIG. 11 is a rear view of an embodiment of a 4 iron golf club head of the present invention.
Figure 12:
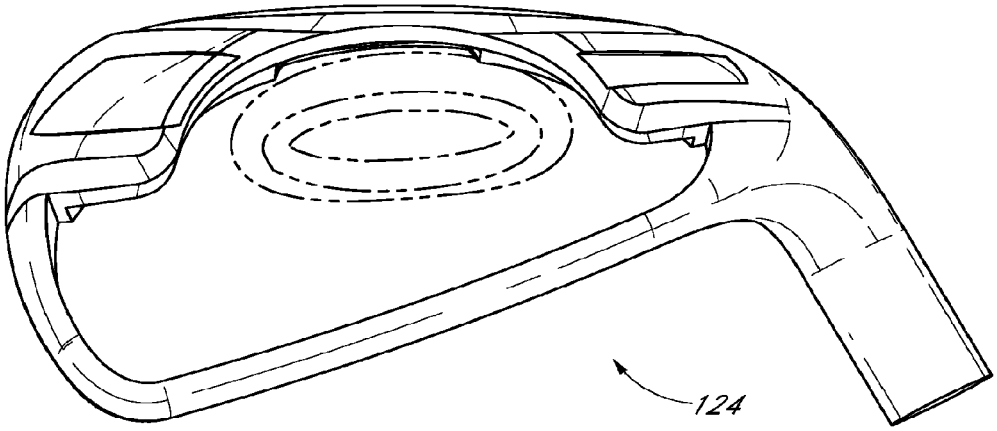
FIG. 12 is a rear view of an embodiment of a 5 iron golf club head of the present invention.
Figure 13:
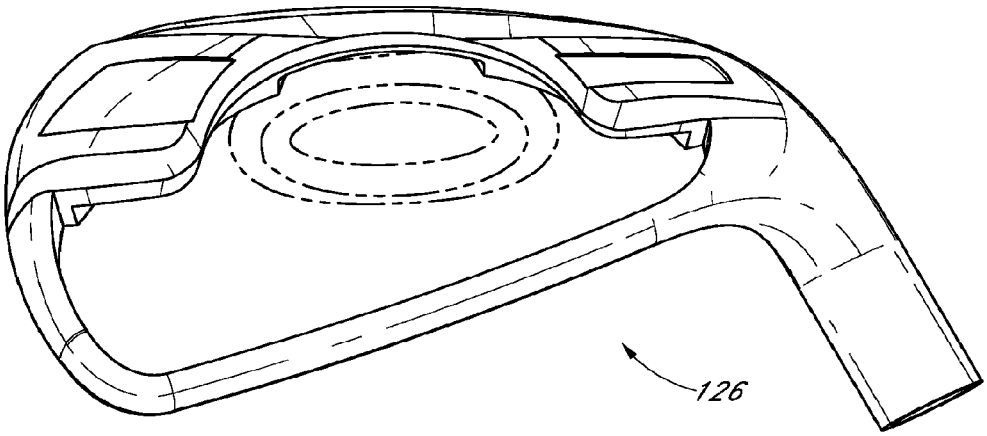
FIG. 13 is a rear view of an embodiment of a 6 iron golf club head of the present invention.
Figure 14:
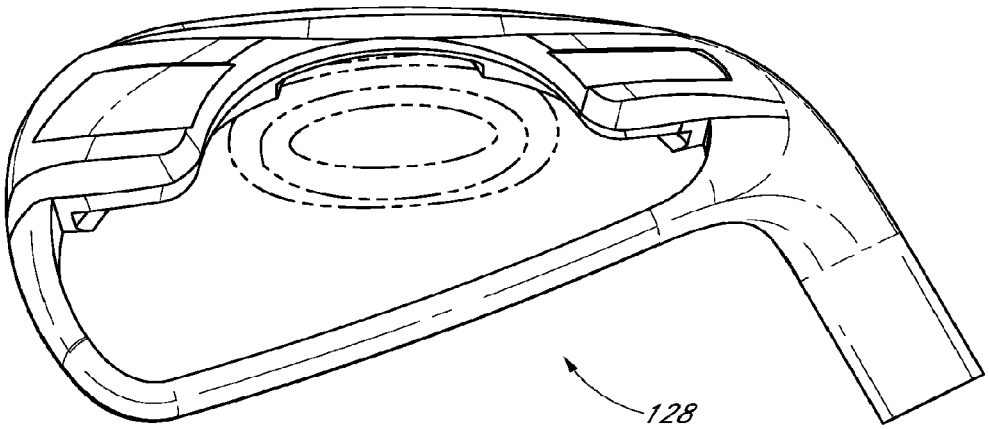
FIG. 14 is a rear view of an embodiment of a 7 iron golf club head of the present invention.
Figure 15:
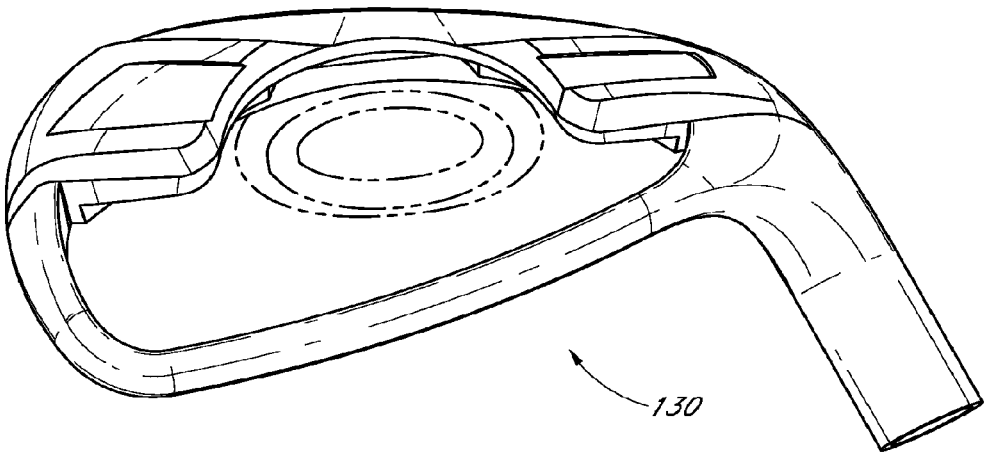
FIG. 15 is a rear view of an embodiment of a 8 iron golf club head of the present invention.
Figure 16:
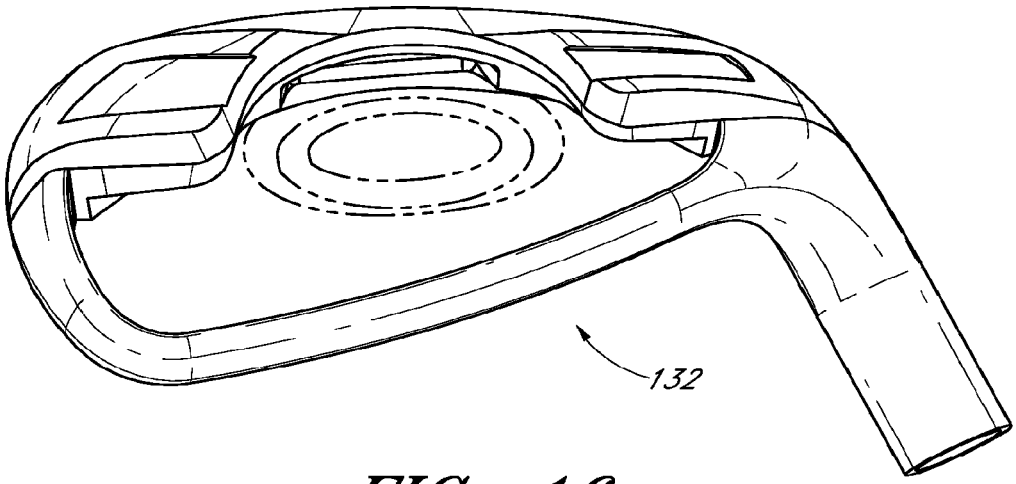
FIG. 16 is a rear view of an embodiment of a 9 iron golf club head of the present invention.
Figure 17:
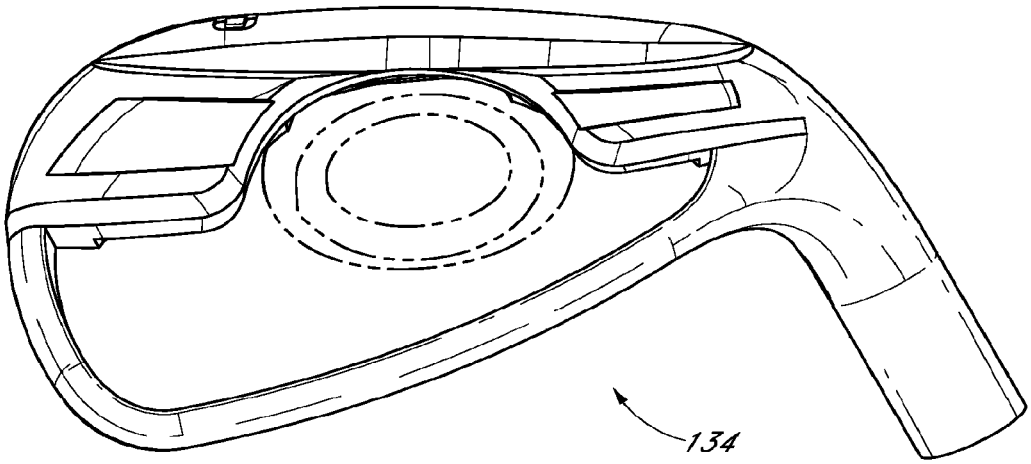
FIG. 17 is a rear view of an embodiment of a pitching wedge golf club head of the present invention.
Figure 18:
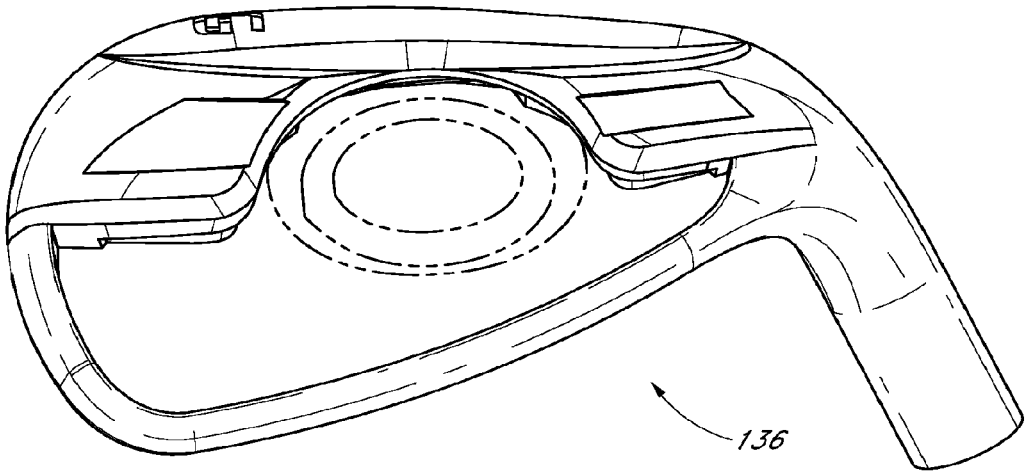
FIG. 18 is a rear view of an embodiment of a gap wedge golf club head of the present invention.
Figure 19:
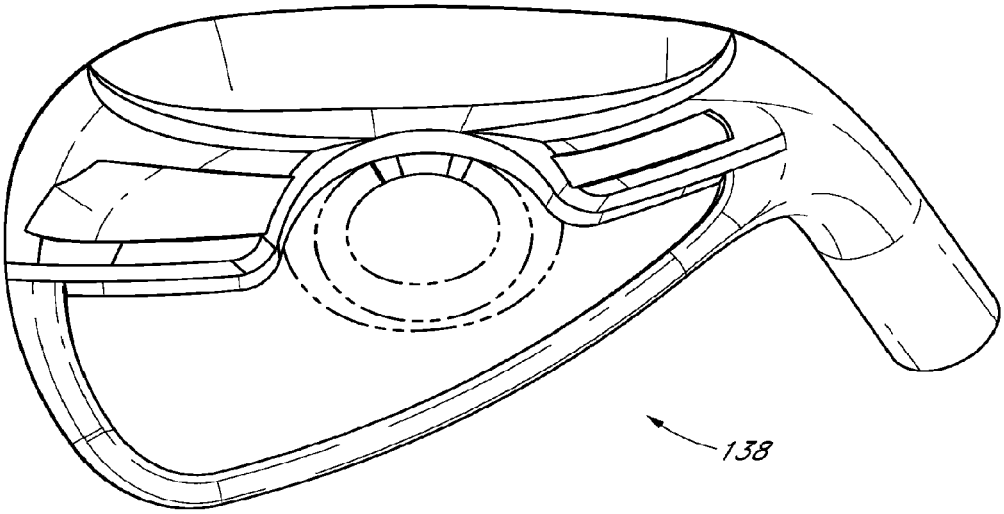
FIG. 19 is a rear view of an embodiment of a sand wedge golf club head of the present invention.

FIG. 6 is a rear view of an embodiment of the golf club head of the present invention, showing an elastomeric insert attached to the back of the golf club head. FIG. 9 is a front view of an embodiment of the elastomeric insert of the present invention. In one embodiment, the golf club head 30 has a body 43 made of a first material. The first material is typically a type of metal, such as carbon steels, stainless steels, titanium, aluminum, and alloys of the aforementioned materials. In one embodiment, the golf club body 43 is made of a first material comprising of 17-4 hypersteel. The golf club head 30 also has an elastomeric insert 81 that is attached to the back of the striking face of the golf club head 30. The elastomeric insert 81 may contain one or more dampening materials, which diminish vibrations in the club head, including vibrations generated during an off-center hit. Preferred dampening materials include those materials known as thermoplastic or thermoset polymers, such as rubber, urethane, polyurethane, butadiene, polybutadiene, silicone, and combinations thereof. Energy is transferred from the club to the ball during impact. Some energy, however, is lost due to vibration of the head caused by the impact. These vibrations produce undesirable sensations in both feel and sound to user. Because the viscoelastic dampening material of the elastomeric insert 81 is in direct contact with the metal club head, especially, with the elliptical pad 60, it serves to dampen these vibrations, improving the sound and feel.

In one embodiment, the golf club head 30 is a cavity back iron, such that the elastomeric insert 81 conveniently fits within the cavity. The elastomeric insert 81 is shaped to have an elliptical portion 80 that corresponds to the elliptical pad of the golf club head 30 as well as the impact pattern for a given golfer or group of golfers of a particular skill for a golf club of a predetermined loft and shaft length. The elastomeric insert 81 is attached to the back of the striking face of the golf club head 30, typically through the use of an adhesive or an adhesive tape. The adhesive tape may itself be constructed of a variety of dampening materials, such as those discussed for the elastomeric insert, and can have various thicknesses. In one embodiment, the elastomeric insert 81 is attached to the back of the striking face of the golf club head 30 using a 3M VHB (very high bond) tape. The elliptical portion 80 of the elastomeric insert 81 is separated by border 82 from the rest of the elastomeric insert 81.

In one embodiment, the elliptical pad 60 is substantially a same first size for the 3 iron, 4 iron and 5 iron, substantially a same second size for the 6 iron and 7 iron, substantially a same third size for the 8 iron and 9 iron, substantially a same fourth size for the pitching wedge and gap wedge, and a fifth size for the sand wedge. The impact location data plots for the aforementioned irons may be grouped into the five groups of irons as indicated above. That is, the impact locations data plots for the 3 iron, 4 iron and 5 iron are substantially similar to one another, the impact location data plots for the 6 iron and 7 iron are substantially similar to one another, and the impact location data plots for the 8 iron and 9 iron are substantially similar to one another, and the impact location data plots for the pitching wedge and gap wedge are substantially similar to one another. In this embodiment, the rest of the back of the striking face 67 is one size for the 3 iron, 4 iron and 5 iron, a second size for the 6 iron and 7 iron, a third size for the 8 iron and 9 iron, a fourth size for the pitching wedge and gap wedge, and a fifth size for the sand wedge. This grouping of five sizes allows for ease of manufacturability, especially in the manufacturing of the elastomeric insert 81, which only needs to have 5 sizes, instead of one size for each of the irons from the 3 iron to the sand wedge.

Figure 7:
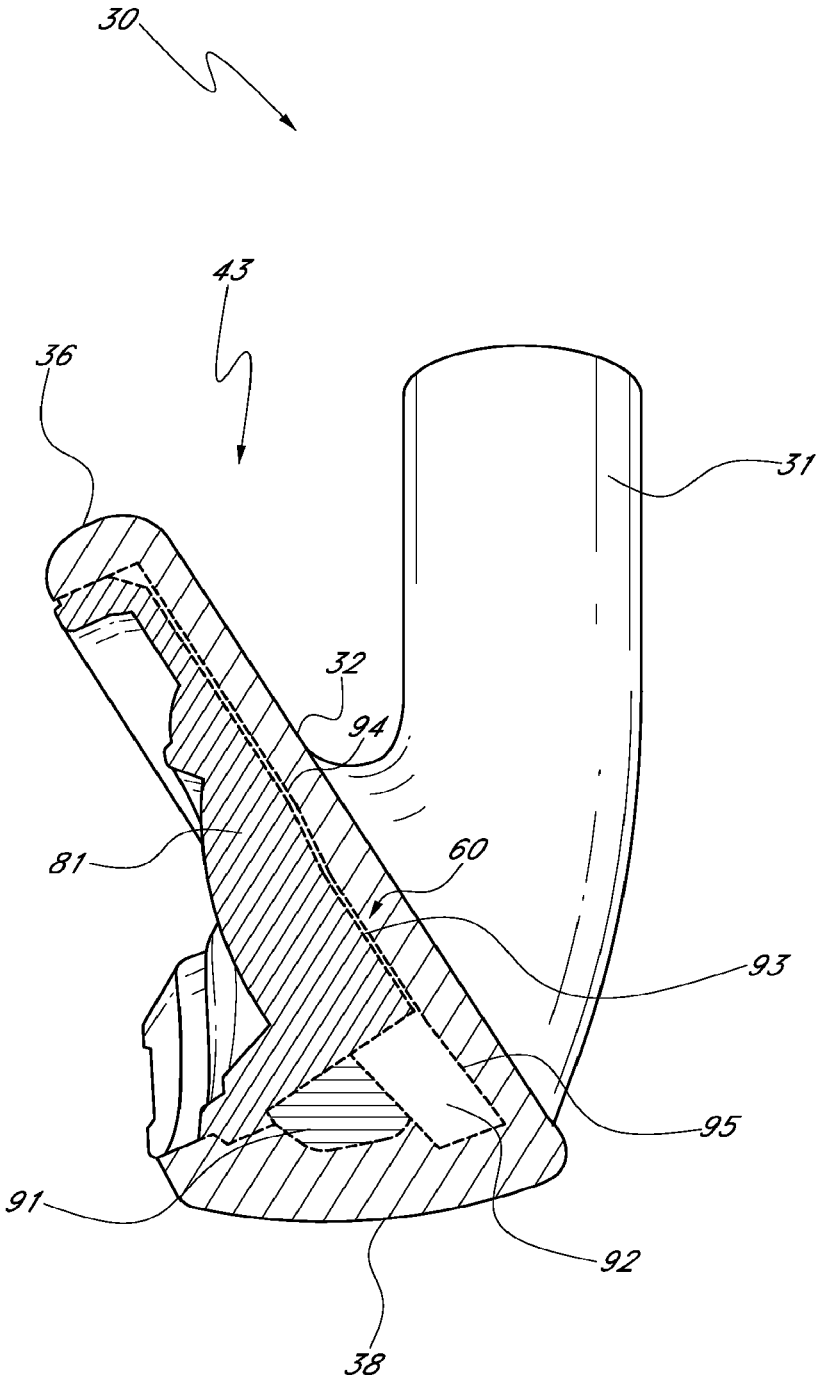
FIG. 7 is a cross-sectional view of an embodiment of the golf club head of the present invention, corresponding to section 7 of FIG. 6.

FIG. 7 is a cross-sectional view of an embodiment of the golf club head of the present invention, corresponding to section 7 of FIG. 6. In one embodiment, back of the striking face 32 of the golf club body 43, has an elliptical pad 60 that extends from location 94 to location 95. The elastomeric insert 81 is attached to the back of the striking face 32 of the golf club body 43. A gap 93 is present between the elastomeric insert 81 and the back of the striking face 32. This gap 93 may be filled with an adhesive or an adhesive tape, facilitating the attachment of the elastomeric insert 81 to the back of the striking face 32.

In one embodiment, the golf club had 43 and may contain a hollow recess 92 and a second insert 91. The second insert 91 is typically made of a dense material, which causes the center of gravity of the golf club head 43 to become closer to the sole 38 and further away from the striking face 32, as compared to a golf club head without the second insert 91.

Figure 8:
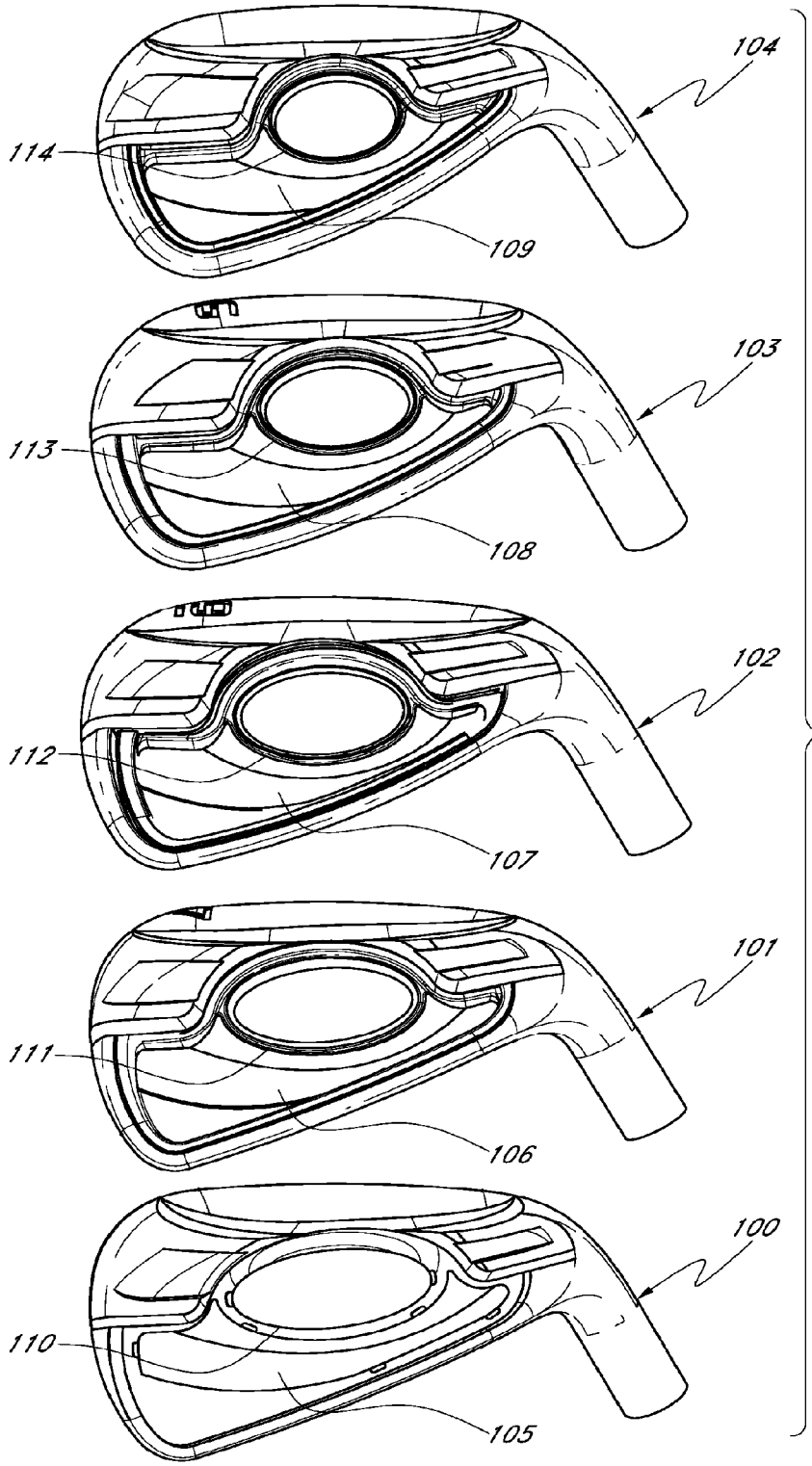
FIG. 8 is an embodiment of the set of golf clubs heads of the present invention.

FIG. 8 is an embodiment of the set of golf clubs heads of the present invention, and shows a 5 iron 100, 7 iron 101, 9 iron 102, gap wedge 103, and sand wedge 104. The golf club heads each have an elastomeric insert, 105, 106, 107, 108 and 109.

The elliptical portions 110, 111, 112, 113 and 114 of the elastomeric inserts, 105, 106, 107, 108 and 109 progressively change in shape and location, which correspond to the elliptical pad of the golf club head as well as the impact pattern for a given golfer or group of golfers of a particular skill for the given golf club. In one embodiment, the elliptical portion of the elastomeric insert 109 for the sand wedge 104 has an elliptical portion 114. This elliptical portion 114 has a ratio of major axis length to minor axis length that is closer to 1 (e.g., it is shaped more like a circle), than the elliptical portion 113 of the elastomeric insert 108 for the gap wedge 103. Similarly, in the progression from wedges, to short irons, and to the longer irons, the ratio of major axis length to minor axis length for the elliptical portions of the respective elastomeric inserts of the different golf club heads become larger.

As discussed above, the elliptical pad may vary between different golf clubs of different lofts and shaft lengths. In one embodiment of the invention, the elliptical pad varies between long irons, mid-irons, short irons and wedges, correlating to the location, shape and size of a given golfer or group of golfer's impact pattern for the particular golf club of a given loft and length. Various parameters may be altered to achieve the desired size, shape and location of the elliptical pad across the entire set of golf clubs, in attempting to match each and every golf club head design to its respective ball strike impact data.

In one embodiment, the location of the center of the elliptical pad is the same for each and every golf club head in the progressive set. In another embodiment, the difference between the first major axis and first minor axis of a first golf club head, is greater than, the difference between the second major axis and second minor axis of a second golf club head. Typically, the first golf club head has less loft than the second golf club head. In this progressive set the difference between the major axis and minor axis for a golf club head in this set, becomes less as the loft of the golf club head increases. It can also be said that from the long irons to the mid irons, short irons and wedges, the elliptical pad becomes shaped more like a circle as the loft of the golf club head increases.

In another embodiment, a first club head has an area defined by the back of the striking face. The first club head also has an area associated with the elliptical pad or alternatively the major and minor axes of the elliptical pad of the first club head. A first ratio is defined as the area of the back of the striking face of the first golf club head in proportion to the area of the first elliptical pad. Similarly, a second club head has an area defined by the back of the striking face. The second club head also has an area associated with the elliptical pad or alternatively the major and minor axes of the elliptical pad of the second club head. A second ratio is defined as the area of the back of the striking face of the second golf club head in proportion to the area of the second elliptical pad. The first ratio is larger than the second ratio. Typically, the first club head has a loft that is lower than the loft of the second golf club head, and this ratio becomes smaller as the golf club head increases in loft in a progressive set. As an example, in one embodiment, a 5 iron (first club) may have a first ratio of the area of the back of the striking face in proportion to the area of the elliptical pad of 3.64; a 7 iron (second club) may have a second ratio of the area of the back of the striking face in proportion to the area of the elliptical pad of 3.45; a 9 iron (third club) may have a third ratio of the area of the back of the striking face in proportion to the area of the elliptical pad of 3.34; a pitching wedge (fourth club) may have a fourth ratio of the area of the back of the striking face in proportion to the area of the elliptical pad of 2.89; a gap wedge (fifth club) may have a fifth ratio of the area of the back of the striking face in proportion to the area of the elliptical pad of 2.62; and, a sand wedge (sixth club) may have a sixth ratio of the area of the back of the striking face in proportion to the area of the elliptical pad of 2.81.

In another embodiment, a first club head has an area defined by the back of the striking face except for the elliptical pad area. The first club head also has an area associated with the elliptical pad or alternatively the major and minor axes of the elliptical pad of the first club head. A first ratio is defined as the area of the back of the striking face of the first golf club head except for the first elliptical pad area in proportion to the area of the first elliptical pad. Similarly, a second club head has an area defined by the back of the striking face except for the elliptical pad area. The second club head also has an area associated with the elliptical pad or alternatively the major and minor axes of the elliptical pad of the second club head. A second ratio is defined as the area of the back of the striking face of the second golf club head except for the second elliptical pad area in proportion to the area of the second elliptical pad. The first ratio is larger than the second ratio. Typically, the first club head has a loft that is lower than the loft of the second golf club head, and this ratio becomes smaller as the golf club head increases in loft in a progressive set. As an example, in one embodiment, a 5 iron (first club) may have a first ratio of the area of the back of the striking face except for the elliptical pad area in proportion to the area of the elliptical pad of 2.64; a 7 iron (second club) may have a second ratio of the area of the back of the striking face except for the elliptical pad area in proportion to the area of the elliptical pad of 2.45; a 9 iron (third club) may have a third ratio of the area of the back of the striking face except for the elliptical pad area in proportion to the area of the elliptical pad of 2.34; a pitching wedge (fourth club) may have a fourth ratio of the area of the back of the striking face except for the elliptical pad area in proportion to the area of the elliptical pad of 1.89; a gap wedge (fifth club) may have a fifth ratio of the area of the back of the striking face except for the elliptical pad area in proportion to the area of the elliptical pad of 1.62; and, a sand wedge (sixth club) may have a sixth ratio of the area of the back of the striking face except for the elliptical pad area in proportion to the area of the elliptical pad of 1.81.

In another embodiment, a first club head has an elliptical pad on the back of the striking face that has a first major axis and first minor axis. A second club head has an elliptical pad on the back of the striking face that has a second major axis and second minor axis. The second major axis is smaller than the first major axis. Typically, the first club head has a loft that is lower than the loft of the second golf club head and the major axis of the elliptical pad of a golf club head becomes smaller as the golf club head increases in loft in the progressive set.

In another embodiment, a first club head has an elliptical pad on the back of the striking face that has a first major axis and first minor axis. A second club head has an elliptical pad on the back of the striking face that has a second major axis and second minor axis. The first minor axis is smaller than the second minor axes. Typically, the first club head has a loft that is lower than the loft of the second golf club head and the minor axis of the elliptical pad of a golf club head becomes larger as a golf club head increases in loft in the progressive set.

In another embodiment, a first club head has an elliptical pad on the back of the striking face that has a first thickness. A second club head has an elliptical pad on the back of the striking face that has a second thickness. The first thickness is the same as the second thickness. This thickness of the elliptical pad is constant throughout the entire progressive set.

In another embodiment, a first club head has an elliptical pad on the back of the striking face that has a first thickness. A second club head has an elliptical pad on the back of the striking face that has a second thickness. The first thickness is smaller than the second thickness of the second elliptical pad. Typically, the first club head has a loft that is lower than the loft of the second golf club head and the thickness of the elliptical pad of a golf club head becomes thicker as a golf club head increases in loft in the progressive set.

In another embodiment, a first club head has an elliptical pad on the back of the striking face that has a first thickness. The first club head has a striking face with a first thickness. A second club head has an elliptical pad on the back of the striking face that has a second thickness. The second club head has a striking face with a second thickness. The second thickness of the second club head striking face is greater than the first thickness of the first club head striking face. Typically, the first club head has a loft that is lower than the loft of the second golf club head and the thickness of the striking face of a golf club head becomes thicker as a golf club head increases in loft in the progressive set.

In another embodiment, a first club head has an elliptical pad on the back of the striking face that has a first thickness. The first club head has a striking face with a first thickness. A second club head has an elliptical pad on the back of the striking face that has a second thickness. The second club head has a striking face with a second thickness. A first ratio is defined as the first thickness of the elliptical pad of the first club head in proportion to the first thickness of the striking face of the first club head. A second ratio is defined as the second thickness of the elliptical pad of the second club head in proportion to the second thickness of the striking face of the second club head. The first ratio is the same as the second ratio. This ratio of the thickness of the elliptical pad in proportion to the thickness of the striking face of a club head is constant throughout the entire progressive set.

In another embodiment, a first club head has an elliptical pad on the back of the striking face that has a first center location. A second club head has an elliptical pad on the back of the striking face that has a second center location. A first vertical distance is measured along the y-axis from the center of the first elliptical pad to the sole of the first golf club head. A second vertical distance is measured along the y-axis from the center of the second elliptical pad to the sole of the second golf club head. The first vertical distance is greater than the second vertical distance. Typically, the first club head has a loft that is lower than the loft of the second golf club head, and the vertical distance from the center of an elliptical pad to a sole of a club head decreases as the golf club head increases in loft in the progressive set.

Below is a table of golf club parameters of an embodiment of the set of progressive golf clubs of the present invention.

| Iron | loft angle | Club length | major axis | minor axis | elliptical pad area | Other back area | thickness of elliptical pad area | thickness of other back area |
|---|---|---|---|---|---|---|---|---|
| 3 | 19° | 39.25 | 1.60 | 0.85 | 1.10 | 2.90 | 0.5 mm | 2.2 mm |
| 4 | 22° | 38.75 | 1.60 | 0.85 | 1.10 | 2.90 | 0.5 mm | 2.2 mm |
| 5 | 25° | 38.25 | 1.60 | 0.85 | 1.10 | 2.90 | 0.5 mm | 2.2 mm |
| 6 | 28° | 37.75 | 1.54 | 0.91 | 1.16 | 2.84 | 0.5 mm | 2.2 mm |
| 7 | 31° | 37.25 | 1.54 | 0.91 | 1.16 | 2.84 | 0.5 mm | 2.2 mm |
| 8 | 35° | 36.75 | 1.44 | 0.89 | 1.06 | 2.48 | 0.5 mm | 2.5 mm |
| 9 | 39° | 36.25 | 1.44 | 0.89 | 1.06 | 2.48 | 0.5 mm | 2.5 mm |
| P | 44° | 36.00 | 1.40 | 1.04 | 1.21 | 2.29 | 0.5 mm | 3.1 mm |
| G | 49° | 25.75 | 1.40 | 1.04 | 1.21 | 1.96 | 0.5 mm | 3.2 mm |
| S | 54° | 35.50 | 1.24 | 0.86 | 0.80 | 1.45 | 0.5 mm | 3.2 mm |

units = inches (unless otherwise noted)

FIGS. 10-19 respectively show the rear views of a 3 iron 120, 4 iron 122, 5 iron 124, 6 iron 126, 7 iron 128, 8 iron 130, 9-iron 132, pitching wedge 134, gap wedge 136 and sand wedge 138 of an embodiment of the set of progressive golf club heads of the present invention. The embodiment shown in FIGS. 10-19 approximately correspond to a set of progressive golf clubs with golf club parameters shown in the above table.

Below is a table of golf club parameters of another embodiment of the set of progressive golf clubs of the present invention, showing operative ranges for the various parameters.

| Iron | loft angle | club length | major axis | minor axis | elliptical pad area | Other back area | thickness of elliptical pad area | thickness of other back area |
|---|---|---|---|---|---|---|---|---|
| 3 | 18-21° | 39.25 | 1.0-2.0 | 0.5-1.5 | 0.5-2.5 | 1.0-5.0 | 0.1-2.0 mm | 1.0-4.0 mm |
| 4 | 21-24° | 38.75 | 1.0-2.0 | 0.5-1.5 | 0.5-2.5 | 1.0-5.0 | 0.1-2.0 mm | 1.0-4.0 mm |
| 5 | 24-27° | 38.25 | 1.0-2.0 | 0.5-1.5 | 0.5-2.5 | 1.0-5.0 | 0.1-2.0 mm | 1.0-4.0 mm |
| 6 | 27-30° | 37.75 | 1.0-2.0 | 0.5-1.5 | 0.5-2.5 | 0.8-4.0 | 0.1-2.0 mm | 1.0-4.0 mm |
| 7 | 30-34° | 37.25 | 1.0-2.0 | 0.5-1.5 | 0.5-2.5 | 0.8-4.0 | 0.1-2.0 mm | 1.0-4.0 mm |
| 8 | 34-38° | 36.75 | 1.0-2.0 | 0.5-1.5 | 0.5-2.5 | 0.6-3.5 | 0.1-2.0 mm | 1.0-6.0 mm |
| 9 | 38-42° | 36.25 | 1.0-2.0 | 0.5-1.5 | 0.5-2.5 | 0.6-3.5 | 0.1-2.0 mm | 1.0-6.0 mm |
| P | 42-48° | 36.00 | 0.8-1.8 | 0.5-1.5 | 0.5-2.5 | 0.5-3.2 | 0.2-2.7 mm | 1.0-6.0 mm |
| G | 48-52° | 35.75 | 0.8-1.8 | 0.5-1.5 | 0.5-2.5 | 0.5-3.2 | 0.2-2.7 mm | 1.0-8.0 mm |
| S | 52-60° | 35.50 | 0.8-1.8 | 0.5-1.5 | 0.5-2.5 | 0.4-3.2 | 0.3-2.7 mm | 1.0-8.0 mm |

units = inches (unless otherwise noted)

As used herein, directional references such as rear, front, lower, etc. are made with respect to the club head when grounded at the address position. See, for example, FIGS. 2 and 3. The direction references are included to facilitate comprehension of the inventive concepts disclosed herein, and should not be read as limiting.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention.

For example, while the inventive concepts have been discussed predominantly with respect to iron-type golf club heads, such concepts may also be applied to other club heads, such as wood-types, hybrid-types, and putter-types. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. A progressive set of iron-type golf club heads, comprising:

a first iron-type golf club head, comprising a body defining a striking face, a top line, a sole, a back of the striking face, a heel, and a toe;

wherein the back of the striking face of the first golf club head comprises a first elliptical pad, the first elliptical pad having a first major axis, first minor axis and first thickness;

wherein the first elliptical pad has a first location and the first major axis, first minor axis and first location of the first elliptical pad correspond to a first location and first size of a predetermined golfer's impact pattern based on a loft and club length of the first golf club head; and a second iron-type golf club head, comprising a body defining a striking face, a top line, a sole, a back of the striking face, a heel, and a toe;

wherein the back of the striking face of the second golf club head comprises a second elliptical pad, the second elliptical pad having a second major axis, second minor axis and second thickness;

wherein the second elliptical pad has a second location and the second major axis, second minor axis and second location of the second elliptical pad correspond to a second location and second size of a predetermined golfer's impact pattern based on a loft and club length of the second golf club head, wherein the second elliptical pad is shaped more like a circle than the first elliptical pad, and wherein the progressive set of golf club heads includes a 5 iron and a 9 iron golf club head.

2. The progressive set of golf club heads of claim 1, wherein the difference between the first major axis and first minor axis is greater than the difference between the second major axis and second minor axis.

3. The progressive set of golf club heads of claim 2, wherein the progressive set of golf club heads includes 4 iron and 8 iron golf club heads.

4. The progressive set of golf club heads of claim 2, wherein the first golf club head has a loft that is lower than the loft of the second golf club head.

5. The progressive set of golf club heads of claim 2, wherein the first golf club head has a club length that is longer than the club length of the second golf club head.

6. The progressive set of golf club heads of claim 1, wherein the back of the striking face of the first golf club head defines an area of the back of the striking face of the first golf club head;

wherein the first major axis and first minor axis define an area of the first elliptical pad;

wherein the back of the striking face of the second golf club head defines an area of the back of the striking face of the second golf club head;

wherein the second major axis and second minor axis define an area of the second elliptical pad;

wherein a first ratio is defined as the area of the back of the striking face of the first golf club head in proportion to the area of the first elliptical pad;

wherein a second ratio is defined as the area of the back of the striking face of the second golf club head in proportion to the area of the second elliptical pad;

wherein the first ratio is greater than the second ratio.

7. The progressive set of golf club heads of claim 6, wherein the progressive set of golf club heads includes 3 iron and 7 iron golf club heads.

8. The progressive set of golf club heads of claim 1, wherein the first major axis and first minor axis define an area of the first elliptical pad;

wherein the back of the striking face of the first golf club head except the area of the first elliptical pad defines an area of the back of the striking face except the area of the first elliptical pad of the first golf club head;

wherein the second major axis and second minor axis define an area of the second elliptical pad;

wherein the back of the striking face of the second golf club head except the area of the second elliptical pad defines an area of the back of the striking face except the area of the second elliptical pad of the second golf club head;

wherein a first ratio is defined as the area of the back of the striking face except the area of the first elliptical pad of the first golf club head in proportion to the area of the first elliptical pad;

wherein a second ratio is defined as the area of the back of the striking face except the area of the second elliptical pad of the second golf club head in proportion to the area of the second elliptical pad;

wherein the first ratio is greater than the second ratio.

9. The progressive set of golf club heads of claim 1, further comprising;

a third golf club head, comprising a body defining a striking face, a top line, a sole, a back of the striking face, a heel, and a toe;

wherein the back of the striking face of the third golf club head comprises a third elliptical pad, the third elliptical pad having a third major axis, third minor axis and third thickness;

wherein the third elliptical pad has a third location and the third major axis, third minor axis and third location of the third elliptical pad correspond to a third location and third size of a predetermined golfer's impact pattern based on a loft and club length of the third golf club head.

10. The progressive set of golf club heads of claim 9; wherein the progressive set of golf club heads includes a 7 iron golf club head.

11. The progressive set of golf club heads of claim 9, wherein the difference between the first major axis and first minor axis, is greater than, the difference between the second major axis and second minor axis; and, wherein the difference between the second major axis and second minor axis, is greater than, the difference between the third major axis and third minor axis.

12. The progressive set of golf club heads of claim 9, wherein the back of the striking face of the first golf club head defines an area of the back of the striking face of the first golf club head;

wherein the first major axis and first minor axis define an area of the first elliptical pad;

wherein the back of the striking face of the second golf club head defines an area of the back of the striking face of the second golf club head;

wherein the second major axis and second minor axis define an area of the second elliptical pad;

wherein the back of the striking face of the third golf club head defines an area of the back of the striking face of the third golf club head;

wherein the third major axis and third minor axis define an area of the third elliptical pad;

wherein a first ratio is defined as the area of the back of the striking face of the first golf club head in proportion to the area of the first elliptical pad;

wherein a second ratio is defined as the area of the back of the striking face of the second golf club head in proportion to the area of the second elliptical pad;

wherein a third ratio is defined as the area of the back of the striking face of the third golf club head in proportion to the area of the third elliptical pad;

wherein the first ratio is greater than the second ratio; and wherein the second ratio is greater than the third ratio.

13. A progressive set of iron-type golf club heads, comprising:

a first iron-type golf club head, comprising a body defining a striking face, a top line, a sole, a back of the striking face, a heel, and a toe;

wherein the back of the striking face of the first golf club head comprises a first elliptical pad, the first elliptical pad having a first major axis, first minor axis and first thickness;

wherein the first elliptical pad has a first location and the first major axis, first minor axis and first location of the first elliptical pad correspond to a first location and first size of a predetermined golfer's impact pattern based on a loft and club length of the first golf club head;

a second iron-type golf club head, comprising a body defining a striking face, a top line, a sole, a back of the striking face, a heel, and a toe;

wherein the back of the striking face of the second golf club head comprises a second elliptical pad, the second elliptical pad having a second major axis, second minor axis and second thickness;

wherein the second elliptical pad has a second location and the second major axis, second minor axis and second location of the second elliptical pad correspond to a second location and second size of a predetermined golfer's impact pattern based on a loft and club length of the second golf club head;

wherein the first elliptical pad has a first thickness that is smaller than the second thickness of the second elliptical pad, wherein the second elliptical pad is shaped more like a circle than the first elliptical pad, wherein the progressive set of golf club heads includes 6 iron, 8 iron and pitching wedge golf club heads.

14. The progressive set of golf club heads of claim 13, wherein the striking face of the first golf club head has the same thickness as the thickness of the striking face of the second golf club head.

15. The progressive set of golf club heads of claim 13, further comprising;

a third golf club head, comprising a body defining a striking face, a top line, a sole, a back of the striking face, a heel, and a toe;

wherein the back of the striking face of the third golf club head comprises a third elliptical pad, the third elliptical pad having a third major axis, third minor axis and third thickness;

wherein the third elliptical pad has a third location and the third major axis, third minor axis and third location of the third elliptical pad correspond to a third location and third size of a predetermined golfer's impact pattern based on a loft and club length of the third golf club head;

wherein the second elliptical pad has a second thickness that is smaller than the third thickness of the third elliptical pad.

* * * * *